US010067480B2

(12) United States Patent
Ogasawara et al.

(10) Patent No.: US 10,067,480 B2
(45) Date of Patent: Sep. 4, 2018

(54) TIME CORRECTION SYSTEM, ELECTRONIC DEVICE, TIMEPIECE, AND PROGRAM

(71) Applicant: SEIKO INSTRUMENTS INC., Chiba-shi, Chiba (JP)

(72) Inventors: Kenji Ogasawara, Chiba (JP); Akira Takakura, Chiba (JP); Kazumi Sakumoto, Chiba (JP); Tamotsu Maesawa, Chiba (JP); Kazuhiro Koyama, Chiba (JP); Tomohiro Ihashi, Chiba (JP); Kosuke Yamamoto, Chiba (JP); Ayumi Matsumoto, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 171 days.

(21) Appl. No.: 15/035,691

(22) PCT Filed: Oct. 17, 2014

(86) PCT No.: PCT/JP2014/077682
§ 371 (c)(1),
(2) Date: May 10, 2016

(87) PCT Pub. No.: WO2015/072281
PCT Pub. Date: May 21, 2015

(65) Prior Publication Data

US 2016/0266554 A1 Sep. 15, 2016

(30) Foreign Application Priority Data

Nov. 12, 2013 (JP) ..... 2013-234254
Nov. 12, 2013 (JP) ..... 2013-234255

(51) Int. Cl.
*G04R 20/26* (2013.01)
*G04C 9/00* (2006.01)
(Continued)

(52) U.S. Cl.
CPC ..... *G04R 20/26* (2013.01); *G04C 9/00* (2013.01); *G04C 10/02* (2013.01); *G04G 5/00* (2013.01); *G04G 19/00* (2013.01)

(58) Field of Classification Search
CPC ..... G04R 20/26; G04R 60/14; G04C 9/02; G04C 10/02; G04C 9/00; G04G 5/00;
(Continued)

(56) References Cited

U.S. PATENT DOCUMENTS 4,800,543 A * 1/1989 Lyndon-James ..... G04G 21/04 368/10
5,898,643 A * 4/1999 Yasuoka ..... G04R 20/10 368/47
(Continued)

FOREIGN PATENT DOCUMENTS

JP 2001-099964 * 4/2001
JP 2010-112914 * 5/2010
JP 2010-261905 * 11/2010

OTHER PUBLICATIONS

English translation of JP 2001-099964, retrieved from the Internet Dec. 20, 2017.*
(Continued)

*Primary Examiner* — Vit W Miska
(74) *Attorney, Agent, or Firm* — Adams & Wilks

(57) ABSTRACT

An electronic device includes at least an acquisition unit, an input unit, a time correction amount calculation unit, and a transmitting unit. A timepiece includes at least a receiving unit, a power storage unit, a drive unit, and a control unit. The input unit receives an input of the time displayed by the display unit of the timepiece. The time correction amount calculation unit calculates a time correction amount for correcting the time of the timepiece from a difference between the time, the input of which is received by the input unit and the current time acquired by the acquisition unit.
(Continued)

10 ELECTRONIC DEVICE
102 CONTROL UNIT
101 TIME DATA ACQUISITION UNIT
104 IMAGING UNIT
105 DISPLAY UNIT
106 INPUT UNIT

20 ELECTRONIC TIMEPIECE
207 STEPPING MOTOR
202 CONTROL CIRCUIT
206 REFERENCE SIGNAL GENERATION CIRCUIT
209 STORAGE UNIT
210 INPUT UNIT

The transmitting unit transmits the time correction amount to the timepiece by using light. The receiving unit receives the time correction amount. The power storage unit stores electricity by using power converted from the light. The drive unit drives the indicating hand. The control unit corrects the time displayed by the indicating hand, based on the time correction amount received by the receiving unit. The control unit controls a power storage period in the power storage unit and a receiving period in the receiving unit so as to receive the time correction amount in the receiving period.

10 Claims, 14 Drawing Sheets

(51) Int. Cl.
*G04C 10/02* (2006.01)
*G04G 5/00* (2013.01)
*G04G 19/00* (2006.01)

(58) Field of Classification Search
CPC G04G 5/002; G04G 7/00; G04G 7/02; G04G 19/00; G04G 21/04
See application file for complete search history.

(56) References Cited

U.S. PATENT DOCUMENTS

| | | | | |
|---|---|---|---|---|
| 6,205,091 | B1 * | 3/2001 | Rudolph | G04G 19/08 368/205 |
| 6,850,468 | B2 * | 2/2005 | Fujisawa | G04C 3/14 368/47 |
| 8,520,473 | B2 * | 8/2013 | Honda | G04B 47/06 368/14 |
| 2005/0105401 | A1 | 5/2005 | Akahane et al. | 368/187 |

OTHER PUBLICATIONS

International Search Report dated Jan. 27, 2015 in International Application No. PCT/JP2014/077682 together with English translation thereof.
Abstract, Publication No. JP 2001-099964, Publication Date Apr. 13, 2001.
Abstract, Publication No. JP 2010-112914, Publication Date May 20, 2010.
Abstract, Publication No. JP 2010-261905, Publication Date Nov. 18, 2010.

* cited by examiner

10 ELECTRONIC DEVICE
102 CONTROL UNIT
101 TIME DATA ACQUISITION UNIT
104 IMAGING UNIT
105 DISPLAY UNIT
106 INPUT UNIT

20 ELECTRONIC TIMEPIECE
207 STEPPING MOTOR
202 CONTROL CIRCUIT
206 REFERENCE SIGNAL GENERATION CIRCUIT
209 STORAGE UNIT
210 INPUT UNIT

S101 IS TIME CORRECTION INSTRUCTION INPUT?
S102 TRANSMIT SYNCHRONIZING SIGNAL
S103 CAUSE IMAGING UNIT TO IMAGE TIMEPIECE
S104 IDENTIFY TIME OF TIMEPIECE FROM CAPTURED IMAGE
S105 ACQUIRE CURRENT TIME
S106 CALCULATE TIME CORRECTION AMOUNT
S107 TRANSMIT START SIGNAL
S108 TRANSMIT TIME CORRECTION AMOUNT DATA

S201 IS SYNCHRONIZING SIGNAL RECEIVED?
S202 RECEIVE TIME CORRECTION AMOUNT DATA
S203 CHANGE MODE TO CHARGING PERIOD
S204 SET TIME CORRECTION AMOUNT
S205 DRIVE MOTOR ONE STEP
S206 DEDUCT 1 FROM TIME CORRECTION AMOUNT
S207 TIME CORRECTION AMOUNT=0?

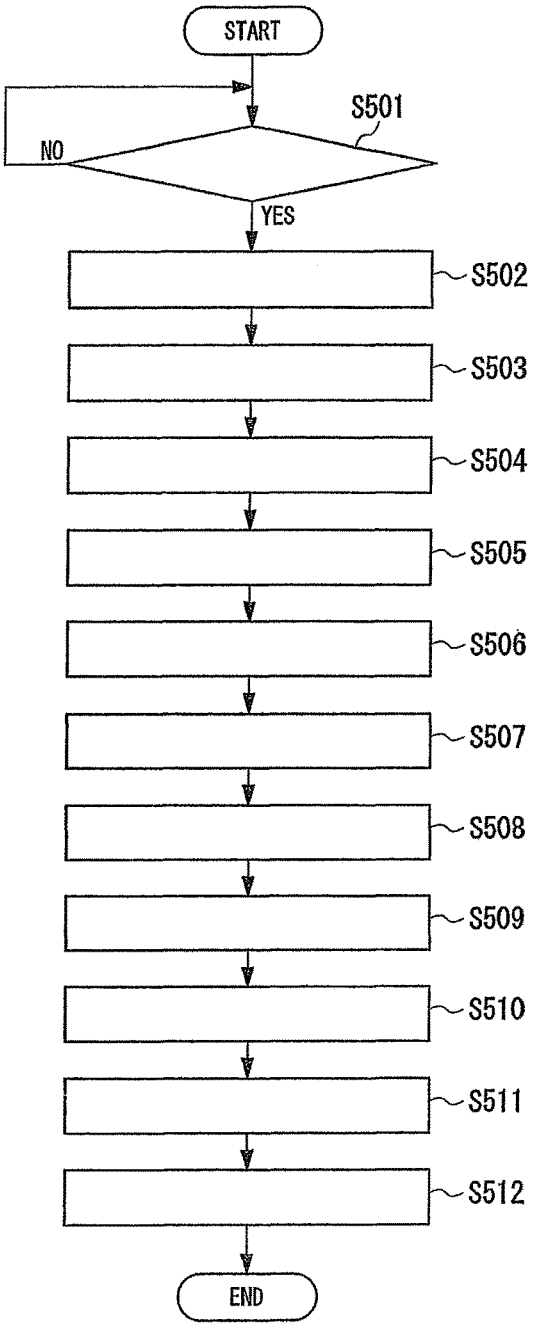

S501 IS TIME CORRECTION INSTRUCTION INPUT?
S502 TRANSMIT SYNCHRONIZING SIGNAL
S503 TRANSMIT START SIGNAL
S504 TRANSMIT STOP SIGNAL
S505 CAUSE IMAGING UNIT TO IMAGE TIMEPIECE
S506 IDENTIFY TIME OF TIMEPIECE FROM CAPTURED IMAGE
S507 ACQUIRE CURRENT TIME
S508 CALCULATE TIME CORRECTION AMOUNT
S509 CALCULATE ADDITIONAL CORRECTION AMOUNT
S510 ADD ADDITIONAL CORRECTION AMOUNT TO TIME CORRECTION AMOUNT
S511 TRANSMIT START SIGNAL
S512 TRANSMIT TIME CORRECTION AMOUNT DATA

FIG.5

S601 IS SYNCHRONIZING SIGNAL RECEIVED?
S602 RECEIVE STOP SIGNAL
S603 STOP CLOCKING
S604 RECEIVE TIME CORRECTION AMOUNT DATA
S605 CHANGE MODE TO CHARGING PERIOD
S606 SET TIME CORRECTION AMOUNT
S607 DRIVE MOTOR ONE STEP
S608 DEDUCT 1 FROM TIME CORRECTION AMOUNT
S609 TIME CORRECTION AMOUNT=0?
S610 RESTART CLOCKING

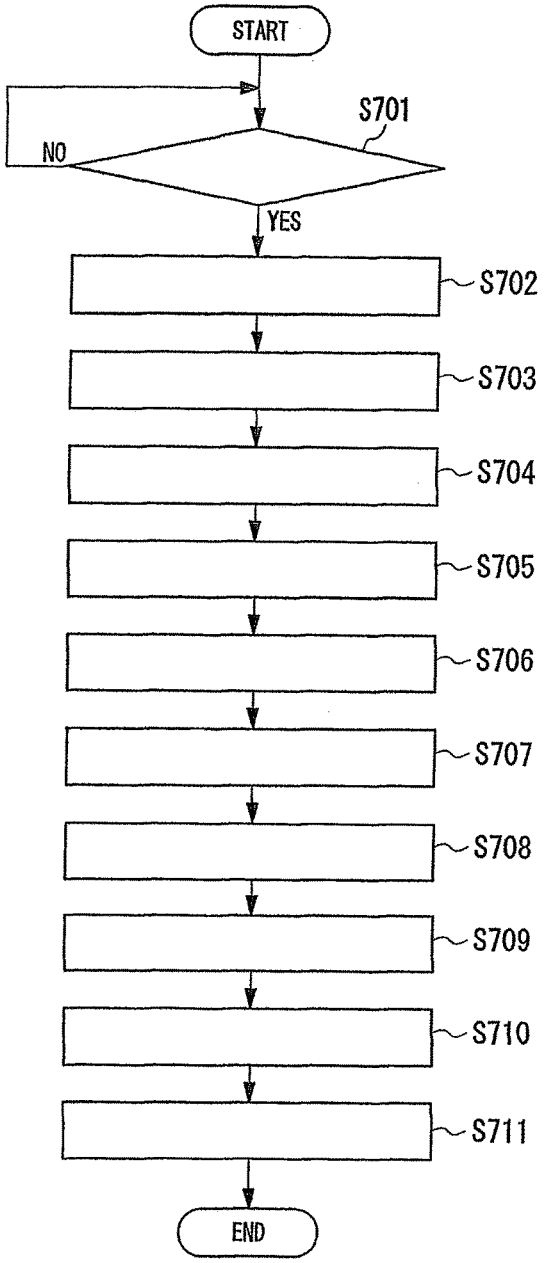

S701 IS TIME CORRECTION INSTRUCTION INPUT?
S702 DISPLAY INSTRUCTION TO STOP CLOCKING
S703 TRANSMIT SYNCHRONIZING SIGNAL
S704 CAUSE IMAGING UNIT TO IMAGE TIMEPIECE
S705 IDENTIFY TIME OF TIMEPIECE FROM CAPTURED IMAGE
S706 ACQUIRE CURRENT TIME
S707 CALCULATE TIME CORRECTION AMOUNT
S708 CALCULATE ADDITIONAL CORRECTION AMOUNT
S709 ADD ADDITIONAL CORRECTION AMOUNT TO TIME CORRECTION AMOUNT
S710 TRANSMIT START SIGNAL
S711 TRANSMIT TIME CORRECTION AMOUNT DATA

FIG.7

S801 IS INSTRUCTION TO STOP CLOCKING INPUT?
S802 STOP CLOCKING
S803 CHANGE MODE TO COMMUNICATION PERIOD
S804 RECEIVE TIME CORRECTION AMOUNT DATA
S805 CHANGE MODE TO CHARGING PERIOD
S806 SET TIME CORRECTION AMOUNT
S807 DRIVE MOTOR ONE STEP
S808 DEDUCT 1 FROM TIME CORRECTION AMOUNT
S809 TIME CORRECTION AMOUNT=0?
S810 RESTART CLOCKING

20 ELECTRONIC TIMEPIECE
207 STEPPING MOTOR
202 CONTROL CIRCUIT206 REFERENCE SIGNAL GENERATION CIRCUIT
209 STORAGE UNIT
210 INPUT UNIT

30 ELECTRONIC DEVICE
102 CONTROL UNIT
101 TIME DATA ACQUISITION UNIT
105 DISPLAY UNIT
106 INPUT UNIT

S1101 IS TIME CORRECTION INSTRUCTION INPUT?
S1102 DISPLAY INSTRUCTION TO STOP CLOCKING
S1103 TRANSMIT SYNCHRONIZING SIGNAL
S1104 IS TIME OF TIMEPIECE INPUT?
S1105 ACQUIRE CURRENT TIME
S1106 CALCULATE TIME CORRECTION AMOUNT
S1107 TRANSMIT START SIGNAL
S1108 TRANSMIT TIME CORRECTION AMOUNT DATA

S1201 IS INSTRUCTION TO STOP CLOCKING INPUT?
S1202 STOP CLOCKING
S1203 CHANGE MODE TO COMMUNICATION PERIOD
S1204 IS SYNCHRONIZING SIGNAL RECEIVED?
S1205 RECEIVE TIME CORRECTION AMOUNT DATA
S1206 CHANGE MODE TO CHARGING PERIOD
S1207 SET TIME CORRECTION AMOUNT
S1208 DRIVE MOTOR ONE STEP
S1209 DEDUCT 1 FROM TIME CORRECTION AMOUNT
S1210 TIME CORRECTION AMOUNT=0?
S1211 RESTART CLOCKING

S1301 IS TIME CORRECTION INSTRUCTION INPUT?
S1302 TRANSMIT SYNCHRONIZING SIGNAL
S1303 TRANSMIT START SIGNAL
S1304 TRANSMIT STOP SIGNAL
S1305 IS TIME OF TIMEPIECE INPUT?
S1306 ACQUIRE CURRENT TIME
S1307 CALCULATE TIME CORRECTION AMOUNT
S1308 TRANSMIT START SIGNAL
S1309 TRANSMIT TIME CORRECTION AMOUNT DATA

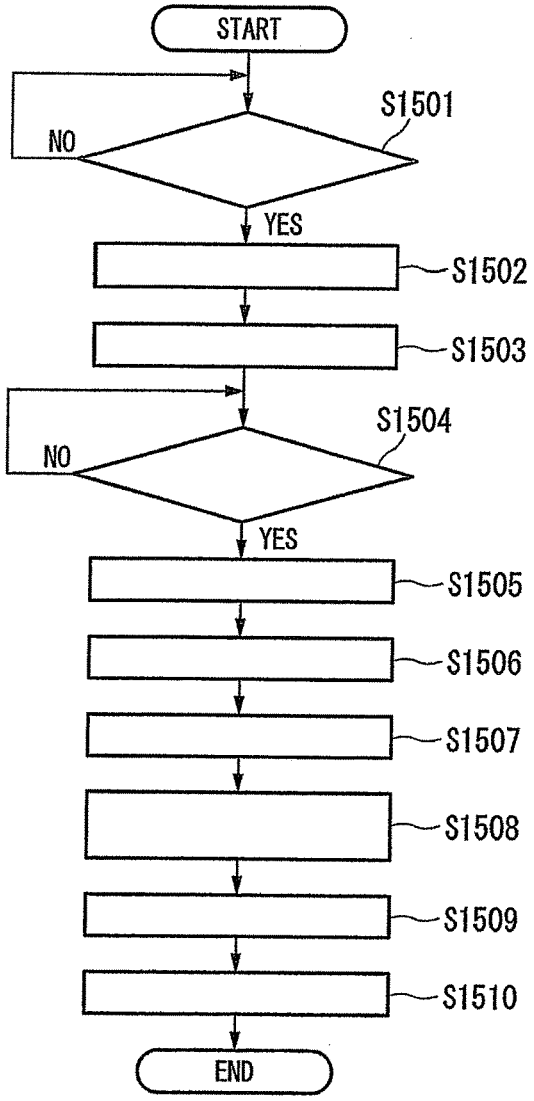

S1501 IS TIME CORRECTION INSTRUCTION INPUT?
S1502 DISPLAY INSTRUCTION TO STOP CLOCKING
S1503 TRANSMIT SYNCHRONIZING SIGNAL
S1504 IS TIME OF TIMEPIECE INPUT?
S1505 ACQUIRE CURRENT TIME
S1506 CALCULATE TIME CORRECTION AMOUNT
S1507 CALCULATE ADDITIONAL CORRECTION AMOUNT
S1508 ADD ADDITIONAL CORRECTION AMOUNT TO TIME CORRECTION AMOUNT
S1509 TRANSMIT START SIGNAL
S1510 TRANSMIT TIME CORRECTION AMOUNT DATA

FIG.13

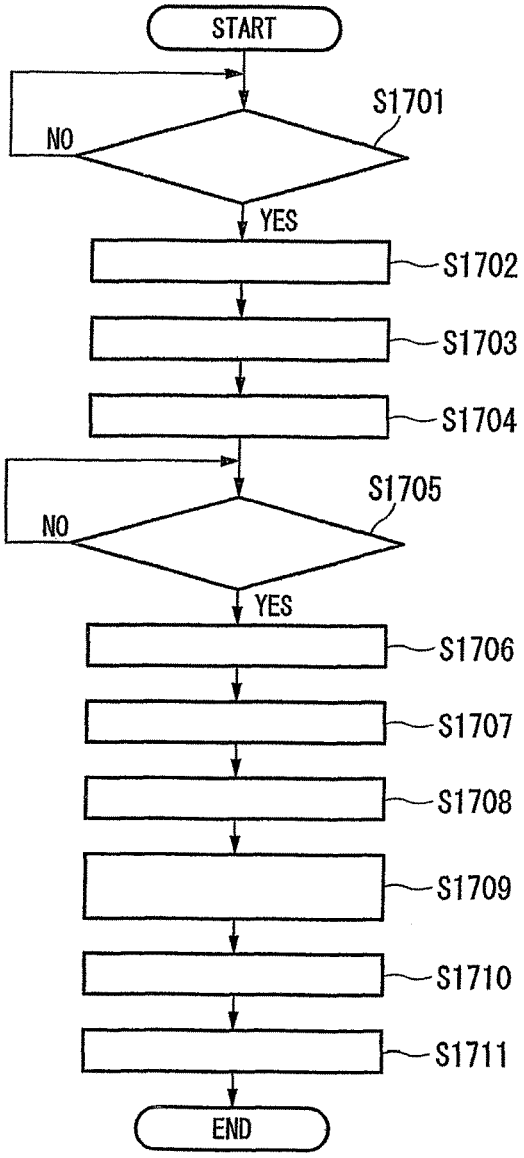

S1701 IS TIME CORRECTION INSTRUCTION INPUT?
S1702 TRANSMIT SYNCHRONIZING SIGNAL
S1703 TRANSMIT START SIGNAL
S1704 TRANSMIT STOP SIGNAL
S1705 IS TIME OF TIMEPIECE INPUT?
S1706 ACQUIRE CURRENT TIME
S1707 CALCULATE TIME CORRECTION AMOUNT
S1708 CALCULATE ADDITIONAL CORRECTION AMOUNT
S1709 ADD ADDITIONAL CORRECTION AMOUNT TO TIME CORRECTION AMOUNT
S1710 TRANSMIT START SIGNAL
S1711 TRANSMIT TIME CORRECTION AMOUNT DATA

FIG.14

TIME CORRECTION SYSTEM, ELECTRONIC DEVICE, TIMEPIECE, AND PROGRAM

TECHNICAL FIELD

The present invention relates to a time correction system, an electronic device, a timepiece, and a program.

This application is based upon and claims the benefit of priority from Japanese Patent Application Nos. 2013-234254 and 2013-234255, filed on Nov. 12, 2013, the entire contents of which are incorporated herein by reference.

BACKGROUND ART

In the related art, a device is known which images a dial of a timepiece and generates indicating hand position information representing a position of an indicating hand for indicating information transcription formed on the dial based on a captured image of the dial so as to write the generated indicating hand position information on the timepiece (for example, refer to PTL 1).

In addition, a time correction system is known which corrects the time of a timepiece by using a correction instruction device such as a computer (for example, refer to PTL 2). According to a technique disclosed in PTL 2, the correction instruction device receives an input of instruction time data instructed by the timepiece, and transmits reference time data and instruction time data to the timepiece. The timepiece corrects indication of an indicating hand, based on the reference time data and the instruction time data which are received from the correction instruction device.

CITATION LIST

Patent Literature

[PTL 1] JP-A-2010-112914
[PTL 2] Japanese Patent No. 4200835

SUMMARY OF INVENTION

Technical Problem

According to the techniques in the related art, the indicating hand position information representing the position of the indicating hand on the dial is written on the timepiece. In addition, based on the reference time data and the instruction time data which are received by the timepiece, the timepiece calculates a difference therebetween.

According to some aspects of the present invention, there are provided a time correction system, an electronic device, a timepiece, and a program which can stably and continuously perform time correction without adopting a complicated configuration.

Solution to Problem

According to an aspect of the present invention, there is provided a time correction system including a timepiece that has a display unit which causes an indicating hand to display the time, and an electronic device. The electronic device includes an acquisition unit that acquires the current time, an input unit that receives an input of the time displayed by the display unit of the timepiece, a time correction amount calculation unit that calculates a time correction amount for correcting the time of the timepiece from a difference between the time, the input of which is received by the input unit and the current time acquired by the acquisition unit, and a transmitting unit that transmits the time correction amount calculated by the time correction amount calculation unit to the timepiece by using light. The timepiece includes a receiving unit that receives the time correction amount from the electronic device, a power storage unit that stores electricity by using power which is converted from the light, a drive unit that drives the indicating hand, and a control unit that corrects the time displayed by the indicating hand, based on the time correction amount received by the receiving unit. The control unit controls a power storage period in the power storage unit and a receiving period in the receiving unit so as to receive the time correction amount in the receiving period.

BRIEF DESCRIPTION OF DRAWINGS

FIG. 5 is a flowchart illustrating a processing procedure in a time correction process performed by an electronic device according to a second embodiment of the present invention.

FIG. 7 is a flowchart illustrating a processing procedure in a time correction process performed by an electronic device according to a third embodiment of the present invention.

FIG. 13 is a flowchart illustrating a processing procedure in a time correction process performed by an electronic device according to a sixth embodiment of the present invention.

FIG. 14 is a flowchart illustrating a processing procedure in a time correction process performed by an electronic device according to a seventh embodiment of the present invention.

DESCRIPTION OF EMBODIMENTS

Figure 1:
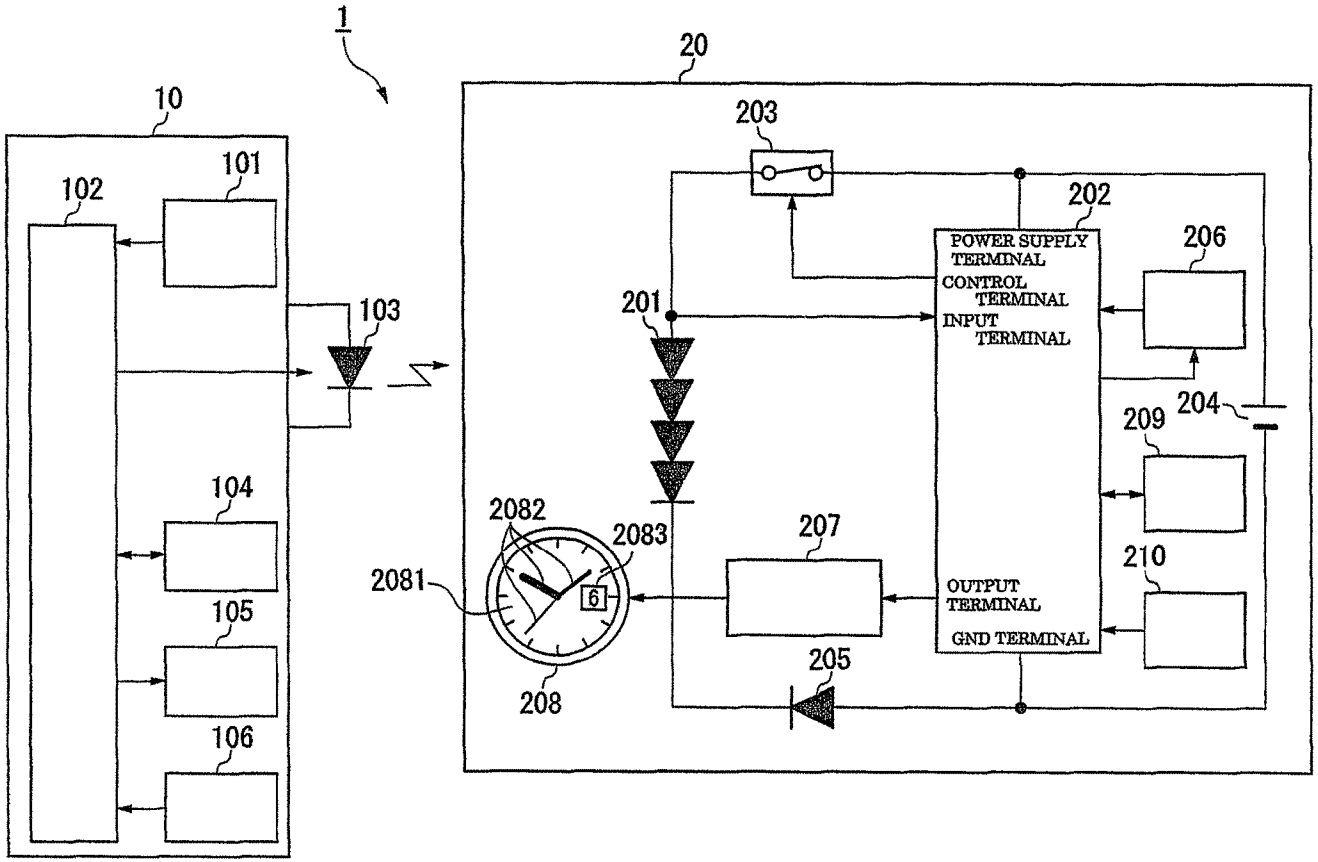
FIG. 1 is a schematic view illustrating a configuration of a time correction system according to a first embodiment of the present invention.

Hereinafter, embodiments of the present invention will be described with reference to the drawings. The same reference numerals will be given to the same elements in each drawing.

[First Embodiment]

First, a first embodiment of the present invention will be described. FIG. 1 is a schematic view illustrating a configuration of a time correction system 1 according to the present embodiment. In the illustrated example, the time correction system 1 includes an electronic device 10 and an electronic timepiece 20. For example, the electronic device 10 is an electronic device such as a smartphone, a mobile phone, and a tablet terminal. In the illustrated example, the electronic device 10 includes a time data acquisition unit 101, a control unit 102, a light source 103, an imaging unit 104, a display unit 105, and an input unit 106.

The time data acquisition unit 101 acquires the current time (second, minute, and hour). For example, the time data acquisition unit 101 employs a method of acquiring the current time by getting access to a time server on the Internet, a method of acquiring the current time by using a Global Positioning System (GPS), or a method of acquiring the current time by using a control signal transmitted from a base station. Any method may be employed in order to acquire the current time.

The control unit 102 controls each unit included in the electronic device 10. In addition, the control unit 102 (identification unit) identifies the time displayed by an indicating hand 2082 from an image of a display unit 208 of the electronic timepiece 20 which is captured by the imaging unit 104. Specifically, the control unit 102 extracts an hour hand, a minute hand, and a second hand from the image of the display unit 208. Then, the control unit 102 identifies the time (second, minute, and hour) displayed by the indicating hand 2082, based on a position relationship between marks (for example, numbers of 1 to 12) printed on a dial 2081 and the extracted hour hand, minute hand, and second hand.

In addition, the control unit 102 (time correction amount calculation unit) calculates a time correction amount for correcting the time of the electronic timepiece 20 from a difference between the time identified from the image of the display unit 208 and the current time acquired by the time data acquisition unit 101. Then, the control unit 102 outputs time correction amount data representing the calculated time correction amount by using the light source 103, as an optical signal.

For example, the light source 103 is a Light Emitting Diode (LED) for a flash belonging to the electronic device 10 or a backlight of a liquid crystal display. The light source 103 is operated as a transmitting unit which transmits an optical signal representing the time correction amount data to the electronic timepiece 20. The imaging unit 104 generates an image by imaging a photographic subject (display unit 208 of the electronic timepiece 20). The display unit 105 is a liquid crystal display (LCD), and displays information. The input unit 106 includes a switch, and receives an input.

The electronic timepiece 20 displays the time in an analog display manner. In the illustrated example, the electronic timepiece 20 includes a solar cell 201, a control circuit 202, a switch 203, a secondary battery 204, a diode 205, a reference signal generation circuit 206, a stepping motor 207, a display unit 208, a storage unit 209, and an input unit 210. The display unit 208 includes the dial 2081, the indicating hand 2082, and a date display section 2083.

In a charging period, the solar cell 201 is operated as a power generation unit which receives light (sunlight or illumination ray) and converts the light into electric energy. In addition, in a communication period, the solar cell 201 performs optical communication with the electronic device 10, and is operated as a receiving unit which receives an optical signal representing the time correction amount data from the electronic device 10. The charging period and the communication period will be described later.

The control circuit 202 controls each unit included in the electronic timepiece 20. In addition, the control circuit 202 controls the solar cell 201 to charge the secondary battery 204. In addition, the control circuit 202 performs an overcharging prevention control for the secondary battery 204. In addition, the control circuit 202 performs optical communication by using the solar cell 201. For example, the control circuit 202 is operated by using power output from the secondary battery 204 which is connected to a power supply terminal and a GND terminal. In this case, the control circuit 202 detects an output voltage of the secondary battery 204, thereby determining a charging state (fully charged or overdischarged state) of the secondary battery 204 and performing a predetermined charging control. For example, the control circuit 202 controls the switch 203 to be turned on and off in response to a charging state of the secondary battery 204 by using a control signal output from a control terminal. In this manner, the control circuit 202 connects the solar cell 201 and the secondary battery 204 to each other, thereby charging the secondary battery 204. In addition, the control circuit 202 disconnects the solar cell 201 and the secondary battery 204 from each other, thereby preventing the secondary battery 204 from being overcharged.

In addition, the control circuit 202 outputs a switch control signal, based on a reference signal output from the reference signal generation circuit 206, thereby controlling the switch 203 to be turned on and off. In this manner, the control circuit 202 connects the solar cell 201 and the secondary battery 204 to each other, and disconnects the solar cell 201 and the secondary battery 204 from each other.

In addition, the control circuit 202 (control unit) detects an output voltage of the solar cell 201 input to an input terminal in a communication period, and converts the detected voltage into an electrical signal, thereby receiving time correction amount data transmitted from an external device (in the present embodiment, the electronic device 10) through optical communication. Then, the control circuit 202 drives the stepping motor 207, and corrects the time displayed by the indicating hand 2082, based on the received time correction amount data.

Based on a switch control signal input from the control circuit 202, the switch 203 connects the solar cell 201 and the secondary battery 204 to each other, and disconnects the solar cell 201 and the secondary battery 204 from each other. The secondary battery 204 supplies power to each unit included in the electronic timepiece 20. The diode 205 prevents a current from reversely flowing into the secondary battery 204. The reference signal generation circuit 206 has an oscillator circuit (for example, 32 kHz) and a frequency divider circuit, and generates a reference signal of 1 Hz, for example.

The stepping motor 207 drives (rotates) the indicating hand 2082 and the date display section 2083, based on a pulse signal input from the control circuit 202. The display unit 208 displays the time and the date in an analog display manner using the dial 2081, the indicating hand 2082, and the date display section 2083. The display unit 208 displays the time by using the dial 2081 and the indicating hand 2082, and displays the date by using the date display section 2083. For example, the storage unit 209 is a non-volatile memory, and stores data used by each unit included in the electronic timepiece 20. The input unit 210 receives an operation input from a user.

Next, a communication method between the electronic device 10 and the electronic timepiece 20 will be described. According to the present embodiment, the electronic device 10 transmits data by using the light source 103. For example, the electronic device 10 causes the light source 103 to emit light when "1" is transmitted, and causes the light source 103 to stop emitting light when "0" is transmitted. In addition, the electronic timepiece 20 receives data by using the solar cell 201. For example, the control circuit 202 of the electronic timepiece 20 determines that "1" is received when the solar cell 201 receives the light and generates a voltage, and determines that "0" is received when the solar cell 201 does not generate the voltage.

When the solar cell 201 and the secondary battery 204 are connected to each other, the voltage generated by the solar cell 201 cannot be accurately determined due to an output voltage of the secondary battery 204. Therefore, according to the present embodiment, when data is received, the switch 203 is controlled in order to more accurately detect the voltage generated by the solar cell 201, thereby disconnecting the solar cell 201 and the secondary battery 204 from each other. A period while the solar cell 201 and the secondary battery 204 are disconnected from each other is referred to as a "communication period (OFF-period)".

In addition, in a period except for the communication period, the switch 203 is controlled, thereby connecting the solar cell 201 and the secondary battery 204 to each other. A period while the solar cell 201 and the secondary battery 204 are connected to each other is referred to as a "charging period (ON-period)". In this manner, in a receiving period, data can be more accurately received.

In addition, the secondary battery 204 cannot be charged in the communication period. For this reason, it is desirable that the communication period is short. Therefore, according to the present embodiment, the electronic timepiece 20 usually employs the charging period, and employs the short communication period at regular intervals. Then, when receiving a synchronizing signal from the electronic device 10 in the short communication period, the electronic timepiece 20 continuously maintains the communication period until the time correction amount data is received. In contrast, when the synchronizing signal is not received from the electronic device 10 in the communication period, the electronic timepiece 20 maintains the charging period.

FIG. 2(A) is a timing chart illustrating timing for the electronic device 10 to transmit the synchronizing signal, start signal, and time correction amount data to the electronic timepiece 20. FIG. 2(B) is a timing chart illustrating timing for the control circuit 202 of the electronic timepiece 20 to output the switch control signal.

As illustrated in FIG. 2(A), when transmitting the time correction amount data, the electronic device 10 transmits the synchronizing signal (time t3 to time t5). Thereafter, the electronic device 10 transmits the start signal (time t6 to time t7). Thereafter, the electronic device 10 transmits the time correction amount data (time t8 to time t9).

In addition, as illustrated in FIG. 2(B), after a fixed period of time elapses from when the mode is changed to the charging period, the electronic timepiece 20 turns off the switch 203, and changes the mode to the communication period (time t1). In addition, the electronic timepiece 20 does not receive the synchronizing signal from when the mode is changed to the communication period. After a fixed period of time elapses, the electronic timepiece 20 turns on the switch 203, and changes the mode to the charging period (time t2). In addition, after a fixed period of time elapses from when the mode is changed to the charging period, the electronic timepiece 20 turns off the switch 203, and changes the mode to the communication period (time t4). At time t4, since the synchronizing signal is transmitted from the electronic device 10, the electronic timepiece 20 receives the synchronizing signal. The electronic timepiece 20 receives the synchronizing signal, thereby changing the mode to the communication period until time t9 when the time correction amount data is completely received. In addition, when the time correction amount data is completely received, the electronic timepiece 20 changes the mode to the charging period (time t9). Thereafter, similarly, the electronic timepiece 20 repeatedly changes the charging period and the communication period, and receives the time correction amount data transmitted from the electronic device 10.

As described above, the electronic timepiece 20 repeatedly changes the charging period and the communication period which is shorter than the charging period. In addition, when the synchronizing signal is received in the shorter communication period, the electronic timepiece 20 changes the mode to the communication period until the time correction amount data is completely received. In this manner, the electronic timepiece 20 can more accurately receive an optical signal while further lengthening the charging period.

Figure 3:
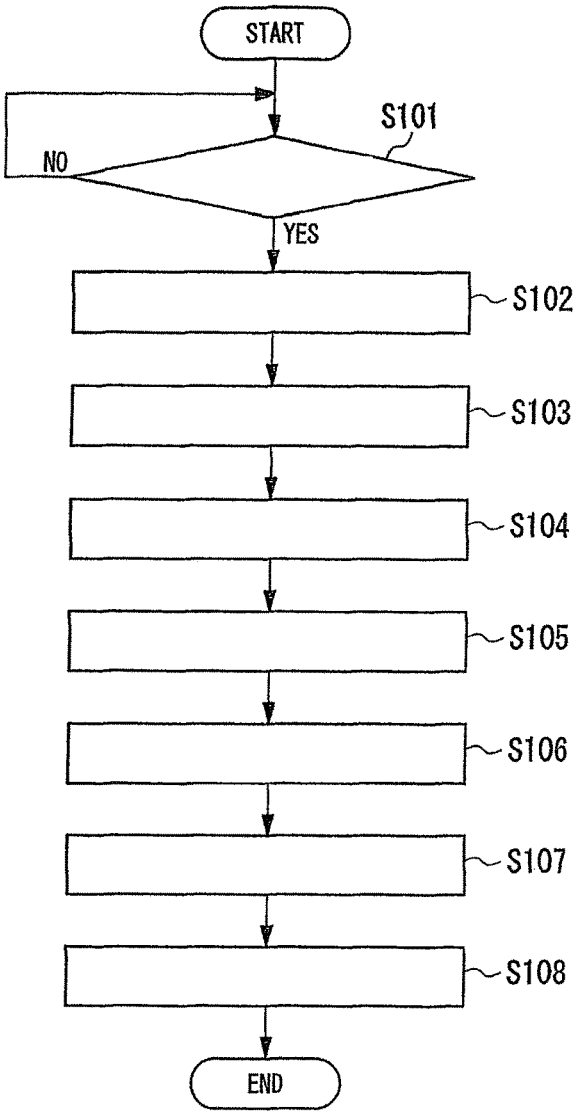
FIG. 3 is a flowchart illustrating a processing procedure in a time correction process performed by an electronic device according to the first embodiment of the present invention.

Next, referring to FIGS. 3 and 4, a time correction method in the time correction system 1 will be described. FIG. 3 is a flowchart illustrating a processing procedure in a time correction process performed by the electronic device 10 according to the present embodiment.

(Step S101)

A user moves the electronic device 10 and the electronic timepiece 20 so that the electronic device 10 can capture an image of the display unit 208 of the electronic timepiece 20. Thereafter, the user operates the input unit 106 of the electronic device 10, and inputs a time correction instruction. When the input unit 106 of the electronic device 10 receives the input of the time correction instruction, the process proceeds to Step S102.

(Step S102)

The control unit 102 controls the light source 103 so as to transmit the synchronizing signal for a fixed period of time. Thereafter, the process proceeds to Step S103.

(Step S103)

After completely transmitting the synchronizing signal, the control unit 102 controls the imaging unit 104 so as to capture the image of the display unit 208 of the electronic timepiece 20. Thereafter, the process proceeds to Step S104.

(Step S104)

The control unit 102 performs image processing, and identifies the time displayed by the electronic timepiece 20, based on the captured image of the display unit 208 of the electronic timepiece 20, which is captured by the imaging unit 104. Thereafter, the process proceeds to Step S105.

(Step S105)

The time data acquisition unit 101 acquires the accurate current time. Thereafter, the process proceeds to Step S106.

(Step S106)

The control unit 102 calculates a difference between the time which is identified in the process in Step S104 and which is displayed by the electronic timepiece 20 and the current time acquired by the time data acquisition unit 101 in the process in Step S105, thereby calculating a time lag of the electronic timepiece 20. In addition, in order to reconcile the time lag of the electronic timepiece 20, the control unit 102 calculates an amount for driving the indicating hand 2082 of the electronic timepiece 20. That is, the control unit 102 calculates an amount for driving the stepping motor 207. Hereinafter, the amount for driving the stepping motor 207 of the electronic timepiece 20 in order to reconcile the time lag of the electronic timepiece 20 is referred to as a time correction amount. For example, the stepping motor 207 is operated one step, thereby causing the indicating hand 2082 to move forward one second. In this case, when the time displayed by the display unit 208 of the electronic timepiece 20 is delayed 10 seconds, the time correction amount is "10". In addition, data indicating the time correction amount is referred to as time correction amount data. Thereafter, the process proceeds to Step S107.

(Step S107)

The control unit 102 controls the light source 103 so as to transmit the start signal. Thereafter, the process proceeds to Step S108.

(Step S108)

The control unit 102 controls the light source 103 so as to transmit the time correction amount data. Thereafter, the process ends.

Figure 4:
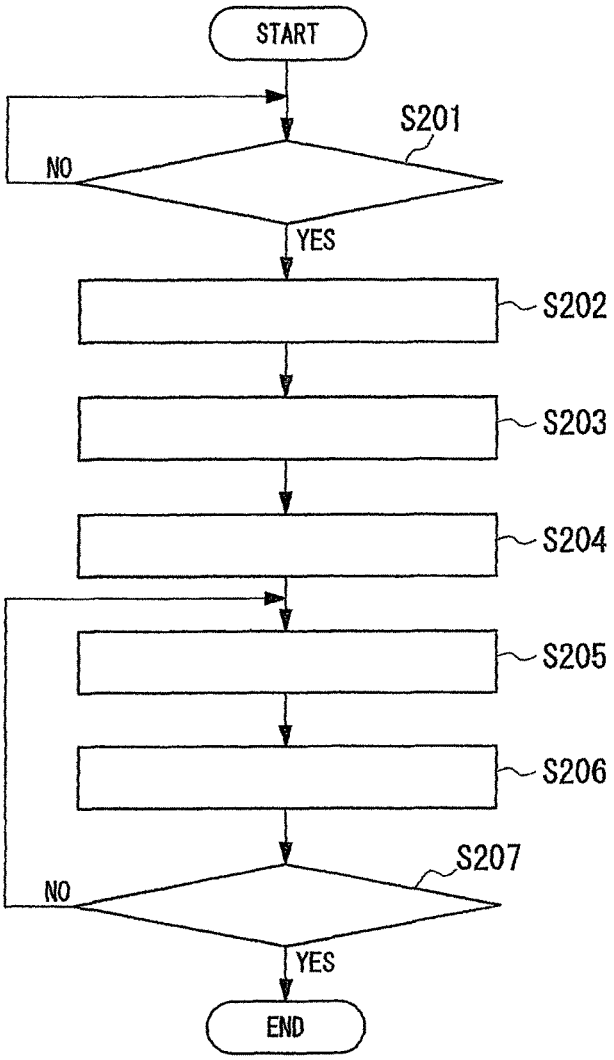
FIG. 4 is a flowchart illustrating a processing procedure in the time correction process performed by the electronic timepiece according to the first embodiment of the present invention.

FIG. 4 is a flowchart illustrating a processing procedure in a time correction process performed by the electronic timepiece 20 according to the present embodiment.

(Step S201)

The control circuit 202 controls the switch 203 so as to control a mode change between the communication period and the charging period at regular intervals. When the control circuit 202 determines that the synchronizing signal is received via the solar cell 201 in the communication period, the process proceeds to Step S202.

(Step S202)

The control circuit 202 maintains the communication period without turning on the switch 203 in an OFF-state. In addition, in the communication period, the control circuit 202 receives the start signal and the time correction amount data via the solar cell 201. Thereafter, the process proceeds to Step S203.

(Step S203)

The control circuit 202 brings the switch 203 into an ON-state, and changes the mode to the charging period. Thereafter, the process proceeds to Step S204.

(Step S204)

The control circuit 202 sets the time correction amount, based on the time correction amount data received in the process in Step S202. Thereafter, the process proceeds to Step S205.

(Step S205)

The control circuit 202 drives the stepping motor 207 one step. Thereafter, the process proceeds to Step S206.

(Step S206)

The control circuit 202 deducts 1 from the set time correction amount, and sets the deducted value as the time correction amount. Thereafter, the process proceeds to Step S207.

(Step S207)

The control circuit 202 determines whether or not the set time correction amount is zero. When the set time correction amount is zero, the control circuit 202 completes the process. Otherwise, the process returns to Step S205.

As described above, according to the present embodiment, the electronic device 10 images the display unit 208 of the electronic timepiece 20, and identifies the time displayed by the electronic timepiece 20, based on the captured image. Then, the electronic device 10 calculates the time correction amount from a difference between the current time and the time displayed by the electronic timepiece 20, and transmits the calculated time correction amount to the electronic timepiece 20. The electronic timepiece 20 corrects the time displayed by the display unit 208, based on the received time correction amount. In this manner, without a need to operate the electronic timepiece 20, a user can more accurately and easily correct the time displayed by the electronic timepiece 20 so as to be the correct time. In addition, the electronic device 10 and the electronic timepiece 20 transmit and receive the time correction amount by using the above-described optical communication method. Accordingly, a connector for wired communication between the electronic device 10 and the electronic timepiece 20 or an antenna for wireless communication therebetween is not necessarily mounted on the electronic device 10 or the electronic timepiece 20. That is, the electronic device 10 can communicate with the light source 103, and the electronic timepiece 20 can communicate with a standard device such as the solar cell 201. Therefore, there is no possibility that design features of the electronic device 10 or the electronic timepiece 20 may become poor due to a newly mounted device.

In addition, according to the present embodiment, light emitted from the light source 103 (transmitting unit) of the electronic device 10 transmitting the time correction amount enables the electronic timepiece 20 on a receiving side to receive the time correction amount and enables the solar cell 201 to perform charging. Accordingly, the electronic device 10 is only provided with the light source 103 (transmitting unit), thereby enabling the electronic timepiece 20 to perform charging and receiving. Therefore, according to the present embodiment, the electronic timepiece 20 can receive the time correction amount and can perform charging by using the solar cell 201 without adopting a complicated configuration. Furthermore, the electronic timepiece 20 can correct the time displayed by the display unit 208 by using power of the charged solar cell 201. Therefore, the electronic timepiece 20 can perform stable and continuous time correction.

[Second Embodiment]

Next, a second embodiment of the present invention will be described. A configuration of the time correction system 1 according to the present embodiment is the same as that according to the first embodiment illustrated in FIG. 1. In addition, an optical communication method of the time correction system 1 according to the present embodiment is the same as the optical communication method illustrated in FIG. 2. The second embodiment and the first embodiment are different from each other in that the electronic timepiece 20 stops clocking when the time is corrected.

Specifically, before the imaging unit 104 images the display unit 208 of the electronic timepiece 20, the control unit 102 (stopping unit) of the electronic device 10 transmits a stop signal to the electronic timepiece 20 so as to stop clocking (driving the indicating hand 2082 and internal clocking) of the electronic timepiece 20. Then, the control unit 102 (additional correction amount calculation unit) calculates a time correction amount, and calculates, an additional correction amount corresponding to a period of time required for correction in the electronic timepiece 20, based on the calculated time correction amount. The additional correction amount means an amount for driving the stepping motor 207 of the electronic timepiece 20 which corresponds to a period of time needed to correct, the time in the electronic timepiece 20. As the time correction amount increases, the additional correction amount increases. As the time correction amount decreases, the additional correction amount decreases. The reason is considered that a period of time is needed to correct the time as the time correction amount increases. Then, the control unit 102 uses the light source 103 so as to output time correction amount data obtained by adding the additional correction amount to the time correction amount, as an optical signal. Other configurations of the electronic device 10 are the same as those according to the first embodiment, and thus, description thereof will be omitted.

If the stop signal is received from the electronic device 10, the control circuit 202 of the electronic timepiece 20 stops clocking (driving the indicating hand 2082 and internal clocking). Thereafter, the control circuit 202 brings the switch 203 into an OFF-state, and changes the mode to the communication period. Then, if the time correction amount data is received, based on the received time correction amount data, the control circuit 202 drives the stepping motor 207 so as to correct the time displayed by the indicating hand 2082, and restarts clocking (driving the indicating hand 2082 and internal clocking). Other configurations of the electronic timepiece 20 are the same as those according to the first embodiment, and thus, description thereof will be omitted.

Next, referring to FIGS. 5 and 6, a time correction method in the time correction system 1 according to the present embodiment will be described. FIG. 5 is a flowchart illustrating a processing procedure in a time correction process performed by the electronic device 10 according to the present embodiment.

(Step S501)

A user moves the electronic device 10 and the electronic timepiece 20 so that the electronic device 10 can capture an image of the display unit 208 of the electronic timepiece 20. Thereafter, the user operates the input unit 106 of the electronic device 10, and inputs a time correction instruction. When the input unit 106 of the electronic device 10 receives the input of the time correction instruction, the process proceeds to Step S502.

(Step S502)

The control unit 102 controls the light source 103 so as to transmit the synchronizing signal for a fixed period of time. Thereafter, the process proceeds to Step S503.

(Step S503)

After completely transmitting the synchronizing signal, the control unit 102 controls the light source 103 so as to transmit the start signal. Thereafter, the process proceeds to Step S504.

(Step S504)

The control unit 102 controls the light source 103 so as to transmit the stop signal. Thereafter, the process proceeds to Step S505.

(Step S505)

The control unit 102 controls the imaging unit 104 so as to capture the image of the display unit 208 of the electronic timepiece 20. Thereafter, the process proceeds to Step S506.

(Step S506)

The control unit 102 performs image processing, and identifies the time displayed by the electronic timepiece 20, based on the captured image of the display unit 208 of the electronic timepiece 20, which is captured by the imaging unit 104. Thereafter, the process proceeds to Step S507.

(Step S507)

The time data acquisition unit 101 acquires the accurate current time. Thereafter, the process proceeds to Step S508.

(Step S508)

The control unit 102 calculates the time correction amount, based on the time which is identified in the process in Step S506 and which is displayed by the electronic timepiece 20, and the current time which is acquired by the time data acquisition unit 101 in the process in Step S507. Thereafter, the process proceeds to Step S509.

(Step S509)

Based on the time correction amount calculated in the process in Step S508, the control unit 102 calculates the additional correction amount. Thereafter, the process proceeds to Step S510.

(Step S510)

The control unit 102 adds the additional correction amount calculated in the process in Step S509 to the time correction amount calculated in the process in Step S508. Thereafter, the process proceeds to Step S511.

(Step S511)

The control unit 102 controls the light source 103 so as to transmit the start signal. Thereafter, the process proceeds to Step S512.

(Step S512)

The control unit 102 controls the light source 103 so as to transmit the time correction amount data. Thereafter, the process ends.

Figure 6:
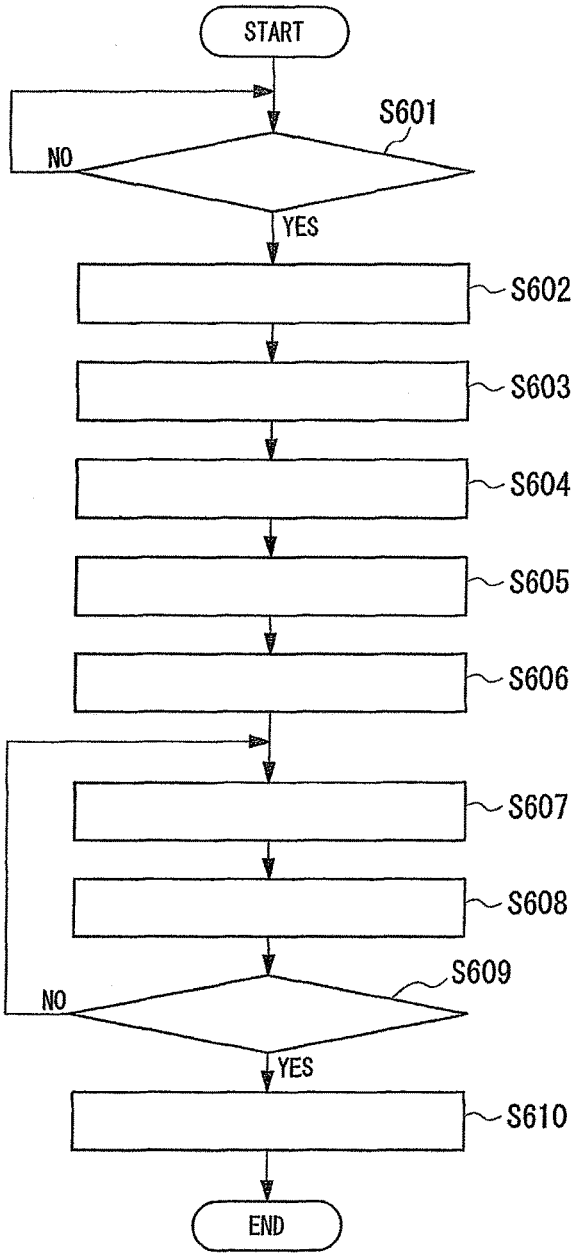
FIG. 6 is a flowchart illustrating a processing procedure in a time correction process performed by an electronic timepiece according to the second embodiment of the present invention.

FIG. 6 is a flowchart illustrating a processing procedure in a time correction process performed by the electronic timepiece 20 according to the present embodiment.

The control circuit 202 controls the switch 203 so as to control a mode change between the communication period and the charging period at regular intervals. When the control circuit 202 determines that the synchronizing signal is received via the solar cell 201 in the communication period, the process proceeds to Step S602.

(Step S602)

The control circuit 202 maintains the communication period without turning on the switch 203 in an OFF-state. In addition, in the communication period, the control circuit 202 receives the start signal and the stop signal via the solar cell 201. Thereafter, the process proceeds to Step S603.

(Step S603)

The control circuit 202 stops clocking. Thereafter, the process proceeds to Step S604.

(Step S604)

The control circuit 202 receives the start signal and the time correction amount data via the solar cell 201. Thereafter, the process proceeds to Step S605.

(Step S605) The control circuit 202 brings the switch 203 into an ON-state, and changes the mode to the charging period. Thereafter, the process proceeds to Step S606.

(Step S606)

The control circuit 202 sets the time correction amount, based on the time correction amount data received in the process in Step S604. Thereafter, the process proceeds to Step S607.

(Step S607)

The control circuit 202 drives the stepping motor 207 one step. Thereafter, the process proceeds to Step S608.

(Step S608)

The control circuit 202 deducts 1 from the set time correction amount, and sets the deducted value as the time correction amount. Thereafter, the process proceeds to Step S609.

(Step S609)

The control circuit 202 determines whether or not the set time correction amount is zero. When the set time correction amount is zero, the control circuit 202 causes the process to proceed to Step S610. Otherwise, the process returns to Step S607.

(Step S610)

The control circuit 202 restarts clocking. Thereafter, the process ends.

As described above, according to the present embodiment, the electronic device 10 stops clocking of the electronic timepiece 20 before imaging the display unit 208 of the electronic timepiece 20. Then, the electronic device 10 calculates the additional correction amount, based on the calculated time correction amount, and transmits the time correction amount data obtained by adding the additional correction amount to the time correction amount, to the electronic timepiece 20. If the time correction amount data is received, the electronic timepiece 20 corrects the time, based on the received time correction amount data, and restarts clocking. That is, the electronic device 10 and the electronic timepiece 20 correct the time in view of a period of time needed to correct the time. Therefore, in addition to an advantageous effect according to the first embodiment, the time can be more accurately corrected.

[Third Embodiment]

Next, a third embodiment of the present invention will be described. A configuration of the time correction system 1 according to the present embodiment is the same as that according to the first embodiment illustrated in FIG. 1. In addition, an optical communication method of the time correction system 1 according to the present embodiment is the same as the optical communication method illustrated in FIG. 2. The third embodiment and the first embodiment are different from each other in that the electronic timepiece 20 stops clocking when the time is corrected. In the above-described second embodiment, clocking of the electronic timepiece 20 is stopped by using the stop signal. However, according to the third embodiment, clocking of the electronic timepiece 20 is stopped by an input from a user.

Before the imaging unit 104 images the display unit 208 of the electronic timepiece 20, the control unit 102 (stopping unit) of the electronic device 10 causes the display unit 105 to display an instruction (for example, "Stop the timepiece") to stop clocking (driving the indicating hand 2082 and internal clocking) of the electronic timepiece 20. In accordance with the display, the user operates the input unit 210 of the electronic timepiece 20 so as to stop clocking (driving the indicating hand 2082 and internal clocking) of the electronic timepiece 20. Then, the control unit 102 calculates the time correction amount, and calculates the additional correction amount, based on the calculated time correction amount. Subsequently, the control unit 102 uses the light source 103 so as to output the time correction amount data obtained by adding the additional correction amount to the time correction amount, as an optical signal. Other configurations of the electronic device 10 are the same as those according to those according to the first embodiment, and thus description thereof will be omitted.

The input unit 210 of the electronic timepiece 20 receives an operation input for stopping clocking (driving the indicating hand 2082 and internal clocking). If the input unit 210 receives the operation input for stopping clocking, the control circuit 202 of the electronic timepiece 20 stops clocking (driving the indicating hand 2082 and internal clocking). Thereafter, the control circuit 202 brings the switch 203 into an OFF-state, and changes the mode to the communication period. Then, if the time correction amount data is received, based on the received time correction amount data, the control circuit 202 drives the stepping motor 207 so as to correct the time displayed by the indicating hand 2082, and restarts clocking (driving the indicating hand 2082 and internal clocking). Other configurations of the electronic timepiece 20 are the same as those according to the first embodiment, and thus description thereof will be omitted.

Next, referring to FIGS. 7 and 8, a time correction method in the time correction system 1 according to the present embodiment will be described. FIG. 7 is a flowchart illustrating a processing procedure in a time correction process performed by the electronic device 10 according to the present embodiment.

(Step S701)

A user moves the electronic device 10 and the electronic timepiece 20 so that the electronic device 10 can capture an image of the display unit 208 of the electronic timepiece 20. Thereafter, the user operates the input unit 106 of the electronic device 10, and inputs a time correction instruction. When the input unit 106 of the electronic device 10 receives the input of the time correction instruction, the process proceeds to Step S702.

(Step S702)

The control unit 102 causes the display unit 105 to display the instruction to stop clocking of the electronic timepiece 20. Thereafter, the process proceeds to Step S703.

(Step S703)

The control unit 102 controls the light source 103 so as to transmit the synchronizing signal for a fixed period of time. Thereafter, the process proceeds to Step S704.

(Step S704)

After completely transmitting the synchronizing signal, the control unit 102 controls the imaging unit 104 so as to capture the image of the display unit 208 of the electronic timepiece 20. Thereafter, the process proceeds to Step S705.

(Step S705)

The control unit 102 performs image processing, and identifies the time displayed by the electronic timepiece 20, based on the captured image of the display unit 208 of the electronic timepiece 20, which is captured by the imaging unit 104. Thereafter, the process proceeds to Step S706.

(Step S706)

The time data acquisition unit 101 acquires the accurate current time. Thereafter, the process proceeds to Step S707.

(Step S707)

The control unit 102 calculates the time correction amount, based on the time which is identified in the process in Step S705 and which is displayed by the electronic timepiece 20 and the current time which is acquired by the time data acquisition unit 101 in the process in Step S706. Thereafter, the process proceeds to Step S708.

(Step S708)

Based on the time correction amount calculated in the process in Step S707, the control unit 102 calculates the additional correction amount. Thereafter, the process proceeds to Step S709.

(Step S709)

The control unit 102 adds the additional correction amount calculated in the process in Step S708 to the time correction amount calculated in the process in Step S707. Thereafter, the process proceeds to Step S710.

(Step S710)

The control unit 102 controls the light source 103 so as to transmit the start signal. Thereafter, the process proceeds to Step S711.

(Step S711)

The control unit 102 controls the light source 103 so as to transmit the time correction amount data. Thereafter, the process ends.

Figure 8:
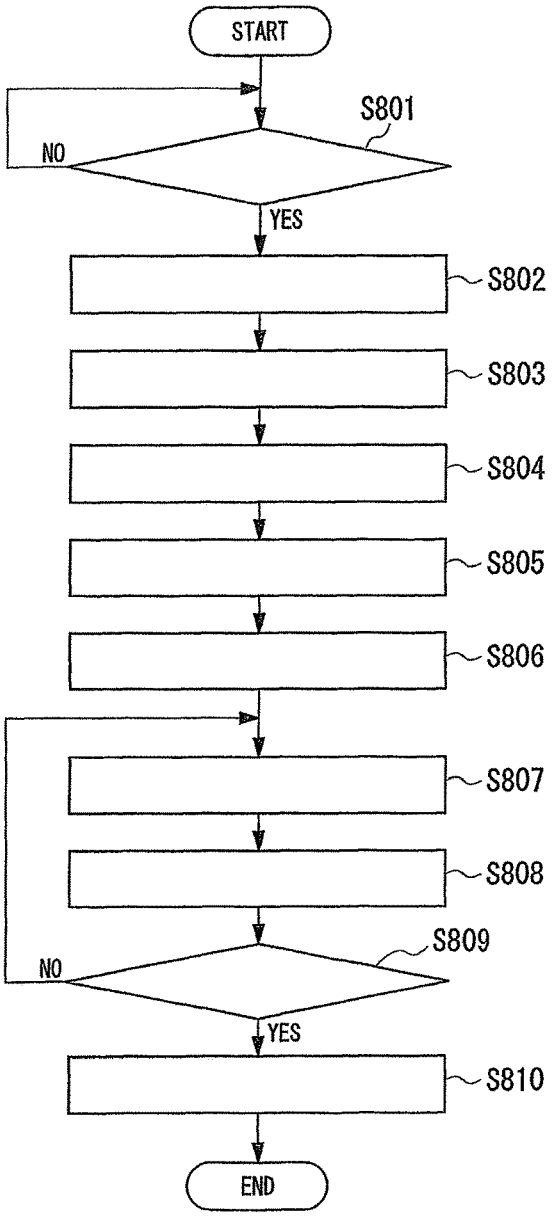
FIG. 8 is a flowchart illustrating a processing procedure in a time correction process performed by an electronic timepiece according to the third embodiment of the present invention.

FIG. 8 is a flowchart illustrating a processing procedure in a time correction process performed by the electronic timepiece 20 according to the present embodiment.

(Step S801)

The control circuit 202 controls the switch 203 so as to control a mode change between the communication period and the charging period at regular intervals. If the electronic device 10 displays the instruction to stop clocking of the electronic timepiece 20 in the process in Step S702 described above, a user operates the input unit 210 of the electronic timepiece 20 so as to input the instruction to stop clocking. When the input unit 210 of the electronic timepiece 20 receives the input of the instruction to stop clocking, the process proceeds to Step S802.

(Step S802)

The control circuit 202 stops clocking. Thereafter, the process proceeds to Step S803.

(Step S803)

The control circuit 202 brings the switch 203 into an OFF-state, and changes the mode to the communication period. When the control circuit 202 determines that the synchronizing signal is received via the solar cell 201 in the communication period, the process proceeds to Step S804.

(Step S804)

The control circuit 202 receives the start signal and the time correction amount data via the solar cell 201. Thereafter, the process proceeds to Step S805.

(Step S805)

The control circuit 202 brings the switch 203 into an ON-state, and changes the mode to the charging period. Thereafter, the process proceeds to Step S806.

(Step S806)

The control circuit 202 sets the time correction amount, based on the time correction amount data received in the process in Step S804. Thereafter, the process proceeds to Step S807.

(Step S807)

The control circuit 202 drives the stepping motor 207 one step. Thereafter, the process proceeds to Step S808.

(Step S808)

The control circuit 202 deducts 1 from the set time correction amount, and sets the deducted value as the time correction amount. Thereafter, the process proceeds to Step S809.

(Step S809)

The control circuit 202 determines whether or not the set time correction amount is zero. When the set time correction amount is zero, the control circuit 202 causes the process to proceed to Step S810. Otherwise, the process returns to Step S807.

(Step S810)

The control circuit 202 restarts clocking. Thereafter, the process ends.

As described above, according to the present embodiment, the electronic device 10 stops clocking of the electronic timepiece 20 before imaging the display unit 208 of the electronic timepiece 20. Then, the electronic device 10 calculates the additional correction amount, based on the calculated time correction amount, and transmits the time correction amount data obtained by adding the additional correction amount to the time correction amount, to the electronic timepiece 20. If the time correction amount data is received, the electronic timepiece 20 corrects the time, based on the received time correction amount data, and restarts clocking. That is, the electronic device 10 and the electronic timepiece 20 correct the time in view of a period of time needed to correct the time. Therefore, in addition to an advantageous effect according to the first embodiment, the time can be more accurately corrected.

[Fourth Embodiment]

Figure 9:
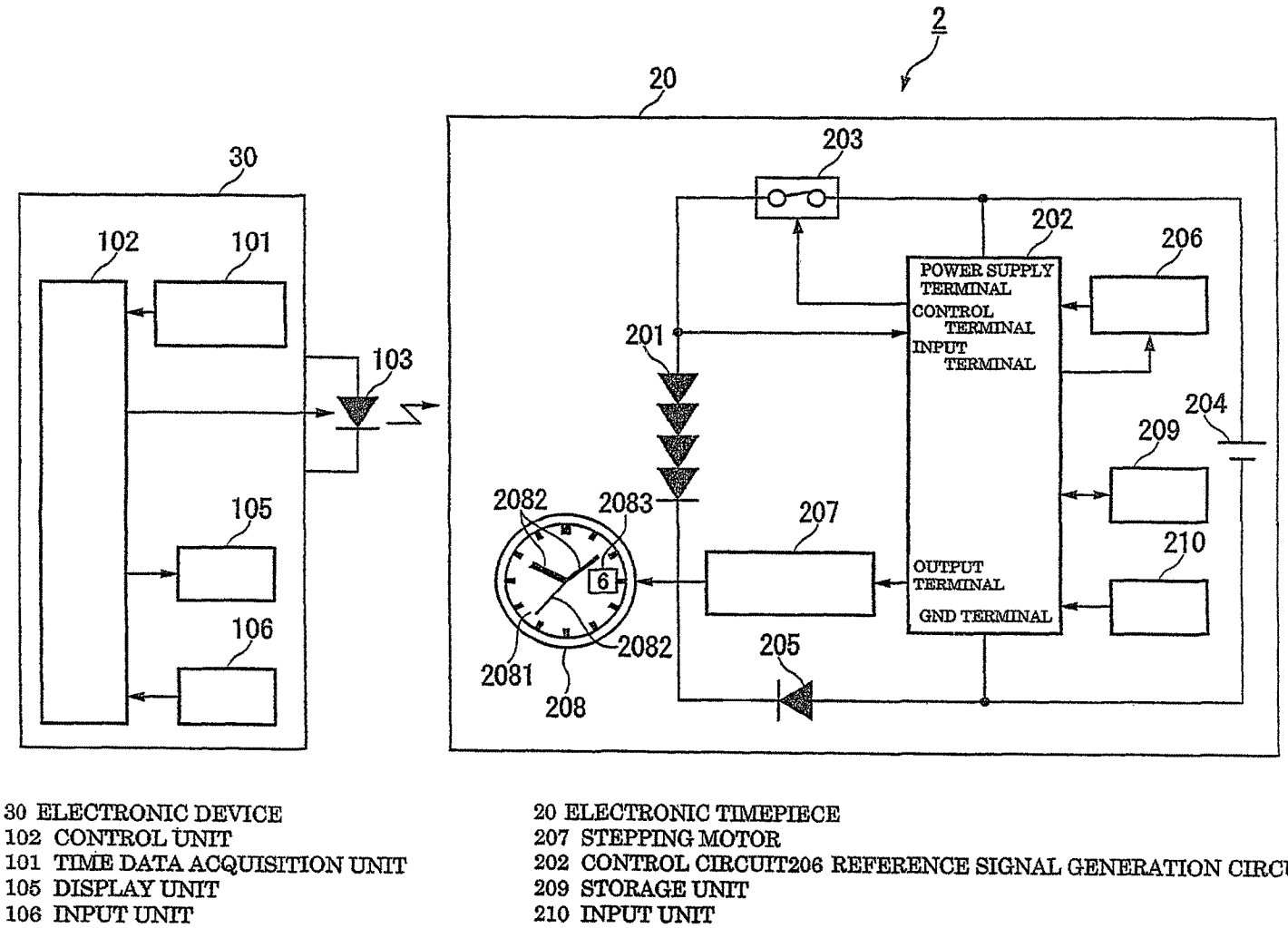
FIG. 9 is a schematic view illustrating a configuration of a time correction system according to a fourth embodiment of the present invention.

Next, a fourth embodiment of the present invention will be described. FIG. 9 is a schematic view illustrating a configuration of a time correction system 2 according to the present embodiment. In the illustrated example, the time correction system 2 includes an electronic device 30 and the electronic timepiece 20. For example, the electronic device 30 is an electronic device such as a smartphone, a mobile phone, and a tablet terminal. In the illustrated example, the electronic device 30 includes the time data acquisition unit 101, the control unit 102, the light source 103, the display unit 105, and the input unit 106.

The time data acquisition unit 101 acquires the current time (second, minute, and hour). For example, the time data acquisition unit 101 employs a method of acquiring the current time by getting access to a time server on the Internet, a method of acquiring the current time by using a Global Positioning System (GPS), or a method of acquiring the current time by using a control signal transmitted from a base station. Any method may be employed in order to acquire the current time.

The control unit 102 controls each unit included in the electronic device 30. In addition, the control unit 102 (stopping unit) causes the display unit 105 to display an instruction (for example, "Stop the timepiece") to stop clocking (driving the indicating hand 2082) of the electronic timepiece 20, thereby stopping clocking (driving the indicating hand 2082) of the electronic timepiece 20. In addition, the control unit 102 (time correction amount calculation unit) calculates the time correction amount for correcting the time of the electronic timepiece 20 from a difference between the time of the electronic timepiece 20 which is input from the input unit 106 and the current time which is acquired by the time data acquisition unit 101. Subsequently, the control unit 102 uses the light source 103 so as to output the time correction amount data indicating the calculated time correction amount, as an optical signal. In this case, the control unit 102 outputs the synchronizing signal, and thereafter outputs the start signal. Thereafter, the control unit 102 outputs the time correction amount data.

For example, the light source 103 is a Light Emitting diode (LED) for a flash belonging to the electronic device 30 or a backlight of a liquid crystal display. The light source 103 is operated as a transmitting unit which transmits an optical signal representing the time correction amount data to the electronic timepiece 20. The display unit 105 is a liquid crystal display (LCD), and displays information. The input unit 106 includes a. switch, and receives an input.

The electronic timepiece 20 displays the time in an analog display manner. In the illustrated example, the electronic timepiece 20 includes the solar cell 201, the control circuit 202, the switch 203, the secondary battery 204, the diode 205, the reference signal generation circuit 206, the stepping motor 207, the display unit 208, the storage unit 209, and the input unit 210. The display unit 208 includes the dial 2081, the indicating hand 2082, and the date display section 2083.

In the charging period, the solar cell 201 is operated as a power generation unit which receives light (sunlight or illumination ray) and coverts the light into electric energy. In addition, in the communication period, the solar cell 201 performs optical communication with the electronic device 30, and is operated as a receiving unit which receives an optical signal representing the time correction amount data from the electronic device 30. The charging period and the communication period will be described later.

The control circuit 202 controls each unit included in the electronic timepiece 20. In addition, the control circuit 202 controls the solar cell 201 to charge the secondary battery 204. In addition, the control circuit 202 performs an overcharging prevention control for the secondary battery 204. In addition, the control circuit 202 performs optical communication by using the solar cell 201. For example, the control circuit 202 is operated by using power output from the secondary battery 204 which is connected to a power supply terminal and a GND terminal. In this case, the control circuit 202 detects an output voltage of the secondary battery 204, thereby determining a charging state (fully charged or overdischarged state) of the secondary battery 204 and performing a predetermined charging control. For example, the control circuit 202 controls the switch 203 to be turned on and off in response to a charging state of the secondary battery 204 by using a control signal output from a control terminal. In this manner, the control circuit 202 connects the solar cell 201 and the secondary battery 204 to each other, thereby charging the secondary battery 204. In addition, the control circuit 202 disconnects the solar cell 201 and the secondary battery 204 from each other, thereby preventing the secondary battery 204 from being overcharged.

In addition, the control circuit 202 outputs a switch control signal, based on a reference signal output from the reference signal generation circuit 206, thereby controlling the switch 203 to be turned on and off. In this manner, the control circuit 202 connects the solar cell 201 and the secondary battery 204 to each other, and disconnects the solar cell 201 and the secondary battery 204 from each other.

In addition, if the input unit 210 receives the operation input for stopping clocking (driving the indicating hand 2082), the control circuit 202 (control unit) stops clocking (driving the indicating hand 2082). Thereafter, the control circuit 202 brings the switch 203 into an OFF-state, and changes the mode to the communication period.

In addition, the control circuit 202 (control unit) detects an output voltage of the solar cell 201 input to an input terminal in the communication period, and converts the detected voltage into an electrical signal, thereby receiving the time correction amount data transmitted from an external device (in the present embodiment, the electronic device 30) through optical communication. If the time correction amount data is received, the control circuit 202 brings the switch 203 into an ON-state, and changes the mode to the charging period. Then, the control circuit 202 drives the stepping motor 207, and corrects the time displayed by the indicating hand 2082, based on the received time correction amount data. The control circuit 202 restarts clocking (driving the indicating hand 2082).

Based on a switch control signal input from the control circuit 202, the switch 203 connects the solar cell 201 and the secondary battery 204 to each other, and disconnects the solar cell 201 and the secondary battery 204 from each other. The secondary battery 204 supplies power to each-unit included in the electronic timepiece 20. The diode 205 prevents a current from reversely flowing into the secondary battery 204. The reference signal generation circuit 206 has an oscillator circuit (for example, 32 kHz) and a frequency divider circuit, and generates a reference signal of 1 Hz, for example.

The stepping motor 207 drives (rotates) the indicating hand 2082 and the date display section 2083, based on a pulse signal input from the control circuit 202. The display unit 208 displays the time and the date in an analog display manner using the dial 2081, the indicating hand 2082, and the date display section 2083. The display unit 208 displays the time by using the dial 2081 and the indicating hand 2082, and displays the date by using the date display section 2083. For example, the storage unit 209 is a non-volatile memory, and stores data used by each unit included in the electronic timepiece 20. The input unit 210 receives an operation input from a user. For example, the input unit 210 receives the operation input for stopping clocking (driving the indicating hand 2082).

Next, a communication method between the electronic device 30 and the electronic timepiece 20 will be described. According to the present embodiment, the electronic device 30 transmits data by using the light source 103. For example, the electronic device 30 causes the light source 103 to emit light when "1" is transmitted, and causes the light source 103 to stop emitting light when "0" is transmitted. In addition, the electronic timepiece 20 receives data by using the solar cell 201. For example, the control circuit 202 of the electronic timepiece 20 determines that "1" is received when the solar cell 201 receives the light and generates a voltage, and determines that "0" is received when the solar cell 201 does not generate the voltage.

When the solar cell 201 and the secondary battery 204 are connected to each other, the voltage generated by the solar cell 201 cannot be accurately determined due to an output voltage of the secondary battery 204. Therefore, according to the present embodiment, when data is received, the switch 203 is controlled in order to more accurately detect the voltage generated by the solar cell 201, thereby disconnecting the solar cell 201 and the secondary battery 204 from each other. A period while the solar cell 201 and the secondary battery 204 are disconnected from each other is referred to as the "communication period (OFF-period)".

In addition, in a period except for the communication period, the switch 203 is controlled, thereby connecting the solar cell 201 and the secondary battery 204 to each other. A period while the solar cell 201 and the secondary battery 204 are connected to each other is referred to as the "charging period (ON-period)". In this manner, in the receiving period, data can be more accurately received.

In addition, the secondary battery 204 cannot be charged in the communication period. For this reason, it is desirable that the communication period is short. Therefore, according to the present embodiment, the electronic timepiece 20 usually employs the charging period, and employs the short communication period at regular intervals. Then, when receiving a synchronizing signal from the electronic device 30 in the short communication period, the electronic timepiece 20 continuously maintains the communication period until the time correction amount data is received. In contrast, when the synchronizing signal is not received from the electronic device 30 in the communication period, the electronic timepiece 20 maintains the charging period.

Figure 2:
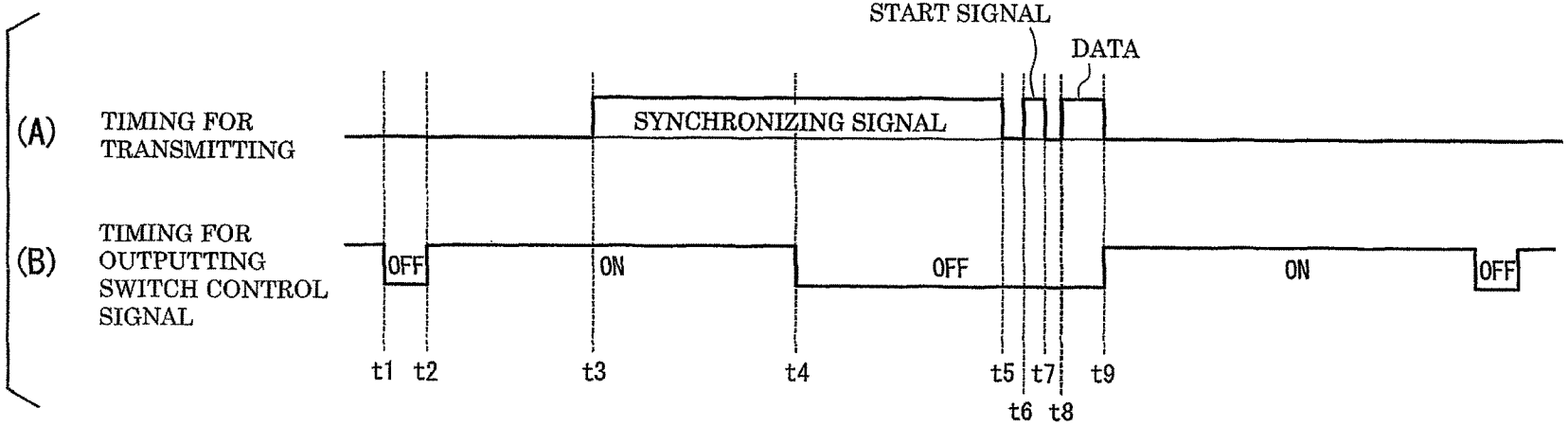
FIGS. 2A and 2B are timing charts for describing an operation example of an electronic timepiece according to the first embodiment of the present invention.

The optical communication method in the time correction system 2 according to the present embodiment is the same as the optical communication method illustrated in FIG. 2. That is, according to the present embodiment, similarly to the first embodiment, the electronic timepiece 20 also repeatedly changes the charging period and the communication period which is shorter than the charging period. In addition, when the synchronizing signal is received in the shorter communication period, the electronic timepiece 20 changes the mode to the communication period until the time correction amount data is completely received. In this manner, the electronic timepiece 20 can more accurately receive an optical signal while further lengthening the charging period.

Figure 10:
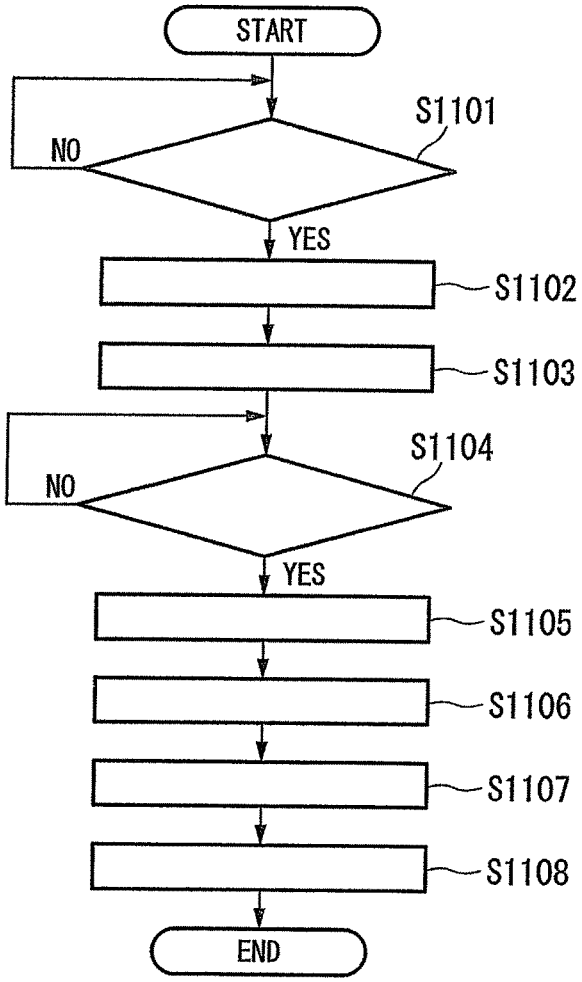
FIG. 10 is a flowchart illustrating a processing procedure in a time correction process performed by an electronic device according to the fourth embodiment of the present invention.

Next, referring to FIGS. 10 and 11, a time correction method in the time correction system 2 will be described. FIG. 10 is a flowchart illustrating a processing procedure in a time correction process performed by the electronic device 30 according to the present embodiment.

(Step S1101)

A user operates the input unit 106 of the electronic device 30, and inputs a time correction instruction. When the input unit 106 of the electronic device 30 receives the input of the time correction instruction, the process proceeds to Step S1102.

(Step S1102)

The control unit 102 causes the display unit 105 to display the instruction to stop clocking of the electronic timepiece 20. Thereafter, the process proceeds to Step S1103.

(Step S1103)

The control unit 102 controls the light source 103 so as to transmit the synchronizing signal for a fixed period of time. Thereafter, the process proceeds to Step S1104.

(Step S1104)

After completely transmitting the synchronizing signal, the control unit 102 receives an input of the time displayed by the indicating hand 2082 of the electronic timepiece 20 from the input unit 106. The user operates the input unit 106, and inputs the time displayed by the indicating hand 2082 of the electronic timepiece 20. When the input unit 106 of the electronic device 30 receives the input of the time displayed by the electronic timepiece 20, the process proceeds to Step S1105.

(Step S1105)

The time data acquisition unit 101 acquires the accurate current time. Thereafter, the process proceeds to Step S1106.

(Step S1106)

The control unit 102 calculates a difference between the time which is input in the process in Step S1104 and which is displayed by the electronic timepiece 20 and the current time acquired by the time data acquisition unit 101 in the process in Step S1105, thereby calculating a time lag of the electronic timepiece 20. In addition, in order to reconcile the time lag of the electronic timepiece 20, the control unit 102 calculates an amount for driving the indicating hand 2082 of the electronic timepiece 20. That is, the control unit 102 calculates an amount for driving the stepping motor 207. Hereinafter, the amount for driving the stepping motor 207 of the electronic timepiece 20 in order to reconcile the time lag of the electronic timepiece 20 is referred to as the time correction amount. For example, the stepping motor 207 is operated one step, thereby causing the indicating hand 2082 to move forward one second. In this case, when the time displayed by the display unit 208 of the electronic timepiece 20 is delayed 10 seconds, the time correction amount is "10". In addition, data indicating the time correction amount is referred to as the time correction amount data. Thereafter, the process proceeds to Step S1107.

(Step S1107)

The control unit 102 controls the light source 103 so as to transmit the start signal. Thereafter, the process proceeds to Step S1108.

(Step S1108)

The control unit 102 controls the light source 103 so as to transmit the time correction amount data. Thereafter, the process ends.

Figure 11:
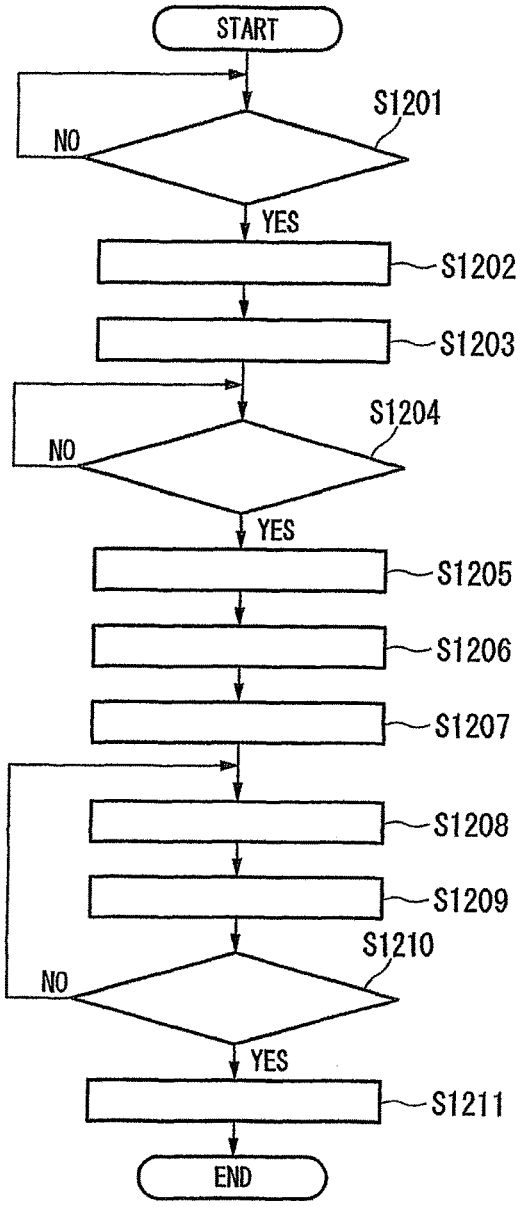
FIG. 11 is a flowchart illustrating a processing procedure in a time correction process performed by an electronic timepiece according to the fourth embodiment of the present invention.

FIG. 11 is a flowchart illustrating a processing procedure in a time correction process performed by the electronic timepiece 20 according to the present embodiment.

(Step S1201)

The control circuit 202 controls the switch 203 so as to control a mode change between the communication period and the charging period at regular intervals. If the electronic device 30 displays the instruction to stop clocking of the electronic timepiece 20 in the process in Step S1102 described above, a user operates the input unit 210 of the electronic timepiece 20 so as to input the instruction to stop clocking. When the input unit 210 of the electronic timepiece 20 receives the input of the instruction to stop clocking, the process proceeds to Step S1202.

(Step S1202)

The control circuit 202 stops clocking. Thereafter, the process proceeds to Step S1203.

(Step S1203)

The control circuit 202 brings the switch 203 into an OFF-state, and changes the mode to the communication period. Thereafter, the process proceeds to Step S1204.

(Step S1204)

The control circuit 202 determines whether or not the synchronizing signal is received via the solar cell 201. When the control circuit 202 determines that the synchronizing signal is received, the process proceeds to Step S1205. Otherwise, the process returns to Step S1204.

(Step S1205)

The control circuit 202 receives the start signal and the time correction amount data via the solar cell 201. Thereafter, the process proceeds to Step S1206.

(Step S1206)

The control circuit 202 brings the switch 203 into an ON-state, and changes the mode to the charging period. Thereafter, the process proceeds to Step S1207.

(Step S1207)

The control circuit 202 sets the time correction amount, based on the time correction amount data received in the process in Step S1205. Thereafter, the process proceeds to Step S1208.

(Step S1208)

The control circuit 202 drives the stepping motor 207 one step. Thereafter, the process proceeds to Step S1209.

(Step S1209)

The control circuit 202 deducts 1 from the set time correction amount, and sets the deducted value as the time correction amount. Thereafter, the process proceeds to Step S1210.

(Step S1210)

The control circuit 202 determines whether or not the set time correction amount is zero. When the set time correction amount is zero, the control circuit 202 causes the ,process to proceed to Step S1211. Otherwise, the process returns to Step S1208.

(Step S1211)

The control circuit 202 restarts clocking. Thereafter, the process ends.

As described above, according to the present embodiment, the electronic device 30 receives the input of the time displayed by the display unit 208 of the electronic timepiece 20, and calculates the time correction amount from a difference between the current time and the time displayed by the electronic timepiece 20. The electronic device 30 transmits the calculated time correction amount to the electronic timepiece 20. Based on the received time correction amount, the electronic timepiece 20 corrects the time displayed by the display unit 208. In this manner, without a need to operate the electronic timepiece 20, a user can more accurately and easily correct the time displayed by the electronic timepiece 20 so as to be the correct time. In addition, since the electronic device 30 calculates the time correction amount, it is possible to reduce a processing load of the electronic timepiece 20.

In addition, the electronic device 30 and the electronic timepiece 20 transmit and receive the time correction amount by using the above-described optical communication method. Accordingly, a connector for wired communication between the electronic device 30 and the electronic timepiece 20 or an antenna for wireless communication therebetween is not necessarily mounted on the electronic device 30 or the electronic timepiece 20. That is, the electronic device 30 can communicate with the light source 103, and the electronic timepiece 20 can communicate with a standard device such as the solar cell 201. Therefore, there is no possibility that design features of the electronic device 30 or the electronic timepiece 20 may become poor due to a newly mounted device.

In addition, according to the present embodiment, light emitted from the light source 103 (transmitting unit) of the electronic device 30 transmitting the time correction amount enables the electronic timepiece 20 on a receiving side to receive the time correction amount and enables the solar cell 201 to perform charging. Accordingly, the electronic device 30 is only provided with the light source 103 (transmitting unit), thereby enabling the electronic timepiece 20 to perform charging and receiving. Therefore, according to the present embodiment, the electronic timepiece 20 can receive the time correction amount and can perform charging by using the solar cell 201 without adopting a complicated configuration. Furthermore, the electronic timepiece 20 can correct the time displayed by the display unit 208 by using power of the charged solar cell 201. Therefore, the electronic timepiece 20 can perform stable and continuous time correction.

[Fifth Embodiment]

Next, a fifth embodiment of the present invention will be described. A configuration of the time correction system 2 according to the present embodiment is the same as that according to the fourth embodiment illustrated in FIG. 9. In addition, an optical communication method of the time correction system 2 according to the present embodiment is the same as the optical communication method illustrated in FIG. 2. According to the fourth embodiment, clocking of the electronic timepiece 20 is stopped by the input from a user. However, according to the fifth embodiment, clocking of the electronic timepiece 20 is stopped by a stop signal from the electronic device 30.

Specifically, the control unit 102 (stopping unit) of the electronic device 30 transmits the stop signal to the electronic timepiece 20 so as to stop clocking (driving the indicating hand 2082) of the electronic timepiece 20. Other configurations of the electronic device 30 are the same as those according to the fourth embodiment, and thus description thereof will be omitted.

If the stop signal is received from the electronic device 30, the control circuit 202 of the electronic timepiece 20 stops clocking (driving the indicating hand 2082). Thereafter, the control circuit 202 brings the switch 203 into an OFF-state, and changes the mode to the communication period. Other configurations of the electronic timepiece 20 are the same as those according to the fourth embodiment, and thus description thereof will be omitted.

Figure 12:
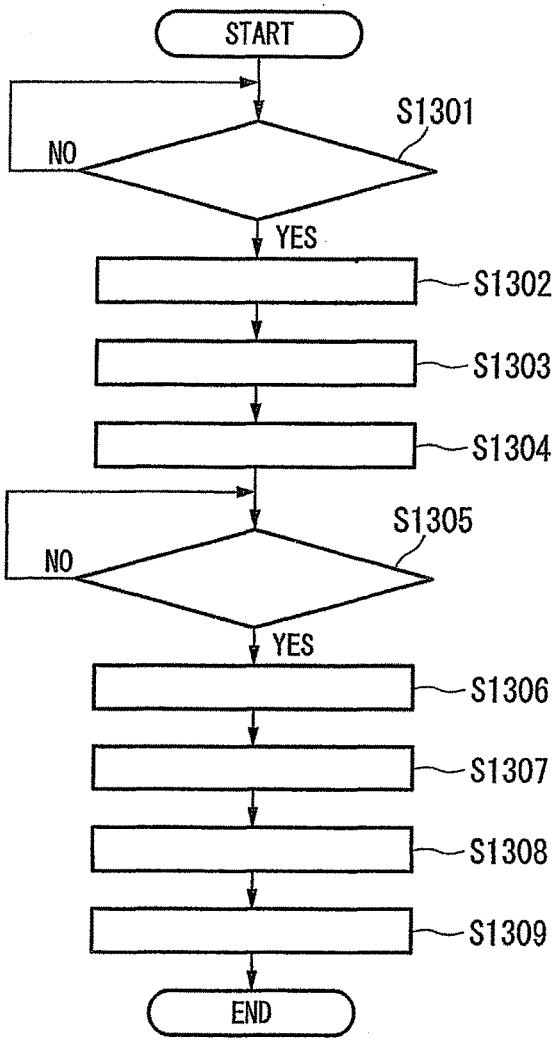
FIG. 12 is a flowchart illustrating a processing procedure in a time correction process performed by an electronic device according to a fifth embodiment of the present invention.

Next, a time correction method in the time correction system 2 according to the present embodiment will be described. FIG. 12 is a flowchart illustrating a processing procedure in a time correction process performed by the electronic device 30 according to the present embodiment.

(Step S1301)

A user operates the input unit 106 of the electronic device 30, and inputs a time correction instruction. When the input unit 106 of the electronic device 30 receives the input of the time correction instruction, the process proceeds to Step S1302.

(Step S1302)

The control unit 102 controls the light source 103 so as to transmit the synchronizing signal for a fixed period of time. Thereafter, the process proceeds to Step S1303.

(Step S1303)

After completely transmitting the synchronizing signal, the control unit 102 controls the light source 103 so as to transmit the start signal. Thereafter, the process proceeds to Step S1304.

(Step S1304)

The control unit 102 controls the light source 103 so as to transmit the stop signal. Thereafter, the process proceeds to Step S1305.

(Step S1305)

The control unit 102 receives the input of the time displayed by the indicating hand 2082 of the electronic timepiece 20 from the input unit 106. The user operates the input unit 106, and inputs the time displayed by the indicating hand 2082 of the electronic timepiece 20. When the input unit 106 of the electronic device 30 receives the input of the time displayed by the electronic timepiece 20, the process proceeds to Step S1306.

(Step S1306)

The time data acquisition unit 101 acquires the accurate current time. Thereafter, the process proceeds to Step S1307.

(Step S1307)

The control unit 102 calculates the time correction amount, based on the time which is input in the process in Step S1305 and which is displayed by the electronic timepiece 20 and the current time which is acquired by the time data acquisition unit 101 in the process in Step S306. Thereafter, the process proceeds to Step S1308.

(Step S1308)

The control unit 102 controls the light source 103 so as to transmit the start signal. Thereafter, the process proceeds to Step S1309.

(Step S1309)

The control unit 102 controls the light source 103 so as to transmit the time correction amount data. Thereafter, the process ends.

The processing procedure in the time correction process performed by the electronic timepiece 20 according to the present embodiment is the same as the processing procedure in the time correction process performed by the electronic timepiece 20 according to the second embodiment illustrated in FIG. 6, and thus description thereof will be omitted.

As described above, according to the present embodiment, the electronic device 30 transmits the stop signal to the electronic timepiece 20 so as to stop the electronic timepiece 20. In this manner, in addition to an advantageous effect according to the fourth embodiment, a user can save labor and time for manually stopping the electronic timepiece 20.

[Sixth Embodiment]

Next, a sixth embodiment of the present invention will be described. A configuration of the time correction system 2 according to the present embodiment is the same as that according to the fourth embodiment illustrated in FIG. 9. In addition, an optical communication method of the time correction system 2 according to the present embodiment is the same as the optical communication method illustrated in FIG. 2. The sixth embodiment and the fourth embodiment are different from each other in that the electronic device 30 adds the additional correction amount to the time correction amount so as to transmit the time correction amount data to the electronic timepiece 20. The additional correction amount means an amount for driving the stepping motor 207 of the electronic timepiece 20 which corresponds to a period of time needed to correct the time in the electronic timepiece 20. As the time correction amount increases, the additional correction amount increases. As the time correction amount decreases, the additional correction amount decreases. The reason is considered that a period of time is needed to correct the time as the time correction amount increases.

Specifically, the control unit 102 (additional correction amount calculation unit) of the electronic device 30 calculates the time correction amount, and calculates the additional correction amount, based on the calculated time correction amount. Then, the control unit 102 uses the light source 103 so as to output time correction amount data obtained by adding the additional correction amount to the time correction amount, as an optical signal. Other configurations of the electronic device 30 are the same as those according to the fourth embodiment, and thus description thereof will be omitted. In addition, a configuration of the electronic timepiece 20 is the same as that according to the fourth embodiment, and thus description thereof will be omitted.

Next, referring to FIG. 13, a time correction method in the time correction system 2 according to the present embodiment will be described. FIG. 13 is a flowchart illustrating a processing procedure in a time correction process performed by the electronic device 30 according to the present embodiment.

(Step S1501)

A user operates the input unit 106 of the electronic device 30, and inputs a time correction instruction. When the input unit 106 of the electronic device 30 receives the input of the time correction instruction, the process proceeds to Step S1502.

(Step S1502)

The control unit 102 causes the display unit 105 to display the instruction to stop clocking of the electronic timepiece 20. Thereafter, the process proceeds to Step S1503.

(Step S1503)

The control unit 102 controls the light source 103 so as to transmit the synchronizing signal for a fixed period of time. Thereafter, the process proceeds to Step S1504.

(Step S1504)

After completely transmitting the synchronizing signal, the control unit 102 receives an input of the time displayed by the indicating hand 2082 of the electronic timepiece 20 from the input unit 106. The user operates the input unit 106, and inputs the time displayed by the indicating hand 2082 of the electronic timepiece 20. When the input unit 106 of the electronic device 30 receives the input of the time displayed by the electronic timepiece 20, the process proceeds to Step S1505.

(Step S1505)

The time data acquisition unit 101 acquires the accurate current time. Thereafter, the process proceeds to Step S1506.

(Step S1506)

The control unit 102 calculates the time correction amount, based on the time which is input in the process in Step S1504 and which is displayed by the electronic timepiece 20 and the current time which is acquired by the time data acquisition unit 101 in the process in Step S1505. Thereafter, the process proceeds to Step S1507.

(Step S1507)

Based on the time correction amount calculated in the process in Step S1506, the control unit 102 calculates the additional correction amount. Thereafter, the process proceeds to Step S1508.

(Step S1508)

The control unit 102 adds the additional correction amount calculated in the process in Step S1507 to the time correction amount calculated in the process in Step S1506. Thereafter, the process proceeds to Step S1509.

(Step S1509)

The control unit 102 controls the light source 103 so as to transmit the start signal. Thereafter, the process proceeds to Step S1510.

(Step S1510)

The control unit 102 controls the light source 103 so as to transmit the time correction amount data. Thereafter, the process ends.

The processing procedure in the time correction process performed by the electronic timepiece 20 according to the present embodiment is the same as the processing procedure in the time correction process performed by the electronic timepiece 20 according to the fourth embodiment illustrated in FIG. 11, and thus description thereof will be omitted.

As described above, according to the present embodiment, the electronic device 30 calculates the additional correction amount, based on the calculated time correction amount, and transmits the time correction amount data obtained by adding the additional correction amount to the time correction amount, to the electronic timepiece 20. That is, the electronic device 30 and the electronic timepiece 20 correct the time in view of a period of time needed to correct the time. Therefore, in addition to an advantageous effect according to the fourth embodiment, the time can be more accurately corrected.

[Seventh Embodiment]

Next, a seventh embodiment of the present invention will be described. A configuration of the time correction system 2 according to the present embodiment is the same as that according to the fourth embodiment illustrated in FIG. 9. In addition, an optical communication method of the time correction system 2 according to the present embodiment is the same as the optical communication method illustrated in FIG. 2. The seventh embodiment is different from the fifth embodiment in that the electronic device 30 adds the additional correction amount to the time correction amount so as to transmit the time correction amount data to the electronic timepiece 20.

Specifically, the control unit 102 (additional correction amount calculation unit) of the electronic device 30 calculates the time correction amount, and calculates the additional correction amount, based on the calculated time correction amount. Then, the control unit 102 uses the light source 103 so as to output time correction amount data obtained by adding the additional correction amount to the time correction amount, as an optical signal. Other configurations of the electronic device 30 are the same as those according to the fifth embodiment, and thus description thereof will be omitted. In addition, a configuration of the electronic timepiece 20 is the same as that according to the fifth embodiment, and thus description thereof will be omitted.

Next, referring to FIG. 14, a time correction method in the time correction system 2 according to the present embodiment will be described. FIG. 14 is a flowchart illustrating a processing procedure in a time correction process performed by the electronic device 30 according to the present embodiment.

(Step S1701)

A user operates the input unit 106 of the electronic device 30, and inputs a time correction instruction. When the input unit 106 of the electronic device 30 receives the input of the time correction instruction, the process proceeds to Step S1702.

(Step S1702)

The control unit 102 controls the light source 103 so as to transmit the synchronizing signal for a fixed period of time. Thereafter, the process proceeds to Step S1703.

(Step S1703)

After completely transmitting the synchronizing signal, the control unit 102 controls the light source 103 so as to transmit the start signal. Thereafter, the process proceeds to Step S1704.

(Step S1704)

The control unit 102 controls the light source 103 so as to transmit the stop signal. Thereafter, the process proceeds to Step S1705.

(Step S1705)

The control unit 102 receives an input of the time displayed by the indicating hand 2082 of the electronic timepiece 20 from the input unit 106. The user operates the input unit 106, and inputs the time displayed by the indicating hand 2082 of the electronic timepiece 20. When the input unit 106 of the electronic device 30 receives the input of the time displayed by the electronic timepiece 20, the process proceeds to Step S1706.

(Step S1706)

The time data acquisition unit 101 acquires the accurate current time. Thereafter, the process proceeds to Step S1707.

(Step S1707)

The control unit 102 calculates the time correction amount, based on the time which is input in the process in Step S1705 and which is displayed by the electronic timepiece 20 and the current time which is acquired by the time data acquisition unit 101 in the process in Step S1706. Thereafter, the process proceeds to Step S1708.

(Step S1708)

Based on the time correction amount calculated in the process in Step S1707, the control unit 102 calculates the additional correction amount. Thereafter, the process proceeds to Step S1709.

(Step S1709)

The control unit 102 adds the additional correction amount calculated in the process in Step S1708 to the time correction amount calculated in the process in Step S1707. Thereafter, the process proceeds to Step S1710.

(Step S1710)

The control unit 102 controls the light source 103 so as to transmit the start signal. Thereafter, the process proceeds to Step S1711.

(Step S1711)

The control unit 102 controls the light source 103 so as to transmit the time correction amount data. Thereafter, the process ends.

The processing procedure in the time correction process performed by the electronic timepiece 20 according to the present embodiment is the same as the processing procedure in the time correction process performed by the electronic timepiece 20 according to the second embodiment illustrated in FIG. 6, and thus description thereof will be omitted.

As described above, according to the present embodiment, the electronic device 30 calculates the additional correction amount, based on the calculated time correction amount, and transmits the time correction amount data obtained by adding the additional correction amount to the time correction amount, to the electronic timepiece 20. That is, the electronic device 30 and the electronic timepiece 20 correct the time in view of a period of time needed to correct the time. Therefore, in addition to an advantageous effect according to the fifth embodiment, the time can be more accurately corrected.

Functions of the respective units included in the electronic devices 10 and 30 and the electronic timepiece 20 according to the above-described embodiments may be entirely or partially realized in such a way that a program for realizing these functions is recorded on a computer-readable recording medium and the program recorded on the recording medium is read and executed by a computer system. The "computer system" described herein includes an OS or hardware such as peripheral devices.

In addition, the "computer-readable recording medium" means a portable medium such as a flexible disk, a magneto-optical disk, a ROM, and a CD-ROM, and a storage unit such as a hard disk incorporated in a computer system. Furthermore, the "computer-readable recording medium" may include those which dynamically hold a program during a short period of time such as network of Internet and communication cables used in a case where the program is transmitted via a communication line of a telephone line, or those which hold the program during a certain period of time such as a volatile memory installed in the computer system functioning as a server or a client in that case. In addition, the above-described program may be one for partially realizing the above-described functions. Furthermore, the program may be combined with a program which previously recorded in the computer system so that the above-described functions can be realized.

Hitherto, the present embodiments according to the present invention have been described. However, without being limited to the above-described embodiments, the present invention can be modified in various ways within the scope not departing from the gist of the present invention.

For example, when the electronic devices 10 and 30 transmit the time correction amount data to the electronic timepiece 20, the whole time correction amount data may be transmitted by being converted into time second data. In this case, the time correction amount data can be directly input as the number of steps of the motor. Accordingly, the electronic timepiece 20 can quickly perform the process from when the time correction amount data is received until the time displayed by the display unit 208 is corrected. In addition, in a case where the whole time correction amount data is transmitted by being converted into time second data when the electronic devices 10 and 30 transmit the time correction amount data to the electronic timepiece 20, it is not necessary for the electronic timepiece 20 to separately prepare a counter for the hour and the minute. Therefore, this is advantageous in view of a circuit configuration for a narrow space such as the electronic timepiece 20.

In addition, according to the above-described embodiments, the electronic timepiece 20 repeatedly changes the mode between the charging period and the communication period for performing the optical communication in a predetermined cycle. However, without being limited thereto, the charging period and the communication period may be switched therebetween by controlling the switch 203 in response to a charging state of the secondary battery 204. Alternatively, in the communication period, the electronic timepiece 20 may first detect the synchronizing signal at a low-speed communication rate, and may receive the start signal and a data signal by switching the low-speed communication rate to a high-speed communication rate- (for example, four times the low-speed communication rate) after the synchronizing signal is detected. This can reduce power consumption of the electronic devices 10 and 30 and the electronic timepiece 20.

In addition, according to the above-described embodiments, the electronic timepiece 20 corrects only the time displayed by the display unit 208, but may correct the date displayed by the display unit 208 in addition to the time. In this case, the control unit 102 of the electronic device 10 extracts the date display section 2083 from the image of the display unit 208, and identifies the date by recognizing the number displayed by the date display section 2083. In addition, the time data acquisition unit 101 acquires the current date and time (current time (hour, minute, and second) and current date (year, month, and day)). In addition, the control unit 102 calculates a date correction amount for correcting the date from a difference between the date determined from the image of the display unit 208 and the current date acquired by the time data acquisition unit 101. Then, the control unit 102 transmits the data indicating the time correction amount and the date correction amount to the electronic timepiece 20. The control circuit 202 of the electronic timepiece 20 corrects the time and the date which are displayed by the display unit 208, based on the received time correction amount and the received date correction amount.

In addition, according to the above-described embodiments, the electronic timepiece 20 corrects only the time displayed by the display unit 208, but may correct the date displayed by the display unit 208 in addition to the time. In this case, the control unit 102 of the electronic device 30 identifies the date from the number which is input from the input unit 106 and which is displayed by the date display section 2083 of the electronic timepiece 20. In addition, the time data acquisition unit 101 acquires the current date and time (current time (hour, minute, and second) and current date (year, month, and day)). In addition, the control unit 102 calculates a date correction amount for correcting the date from a difference between the date input.from the input unit 106 and the current date acquired by the time data acquisition unit 101. Then, the control unit 102 transmits data indicating the time correction amount and the date correction amount to the electronic timepiece 20. The control circuit 202 of the electronic timepiece 20 corrects the time and the date which are displayed by the display unit 208, based on the received time correction amount and the received date correction amount.

According to the present embodiment of the present invention, there is provided a time correction system. The time correction system includes at least a timepiece and an electronic device. The electronic device includes at least an acquisition unit, an input unit, a time correction amount calculation unit, and a transmitting unit. The timepiece includes at least a receiving unit, a power storage unit, a drive unit, and a control unit. The acquisition unit acquires the current time. The input unit receives an input of the time displayed by the display unit of the timepiece. The time correction amount calculation unit calculates a time correction amount for correcting the time of the timepiece from a difference between the time, the input of which is received by the input unit and the current time acquired by the acquisition unit. The transmitting unit transmits the time correction amount calculated by the time correction amount calculation unit to the timepiece by using light. The receiving unit receives the time correction amount from the electronic device. The power storage unit stores electricity by using power converted from the light. The drive unit drives the indicating hand. The control unit corrects the time displayed by the indicating hand, based on the time correction amount received by the receiving unit. The control unit controls a power storage period in the power storage unit and a receiving period in the receiving unit so as to receive the time correction amount in the receiving period.

The transmitting unit of the electronic device may transmit the current time together with the time correction amount. The receiving unit of the timepiece may receive the current time together with the time correction amount. The timepiece may include a clocking unit which clocks the current time. The control unit of the timepiece may correct the current time clocked by the clocking unit, based on the current time received by the receiving unit.

The electronic device may include a stopping unit which stops driving the indicating hand of the timepiece. If the receiving unit receives the time correction amount, the control unit of the timepiece may restart driving the indicating hand.

The electronic device may include an additional correction amount calculation unit which calculates an additional correction amount corresponding to a period of time needed to correct the time in the timepiece, based on the time correction amount calculated by the time correction amount calculation unit, and which adds the calculated additional correction amount to the time correction amount.

The stopping unit of the electronic device may transmit a stop signal for stopping driving the indicating hand to the timepiece. The control unit of the timepiece may stop driving the indicating hand, if the stop signal is received.

The electronic device may include a display unit. The stopping unit of the electronic device may cause the display unit to display an instruction to stop driving the indicating hand. The timepiece may include an input unit which receives an operation input. The control unit of the timepiece may stop driving the indicating hand, if the input unit receives the operation input for stopping driving the indicating hand.

The transmitting unit of the electronic device may be a light source which transmits an optical signal. The receiving unit of the timepiece may be a solar cell which receives the optical signal.

The input unit may include a switch. An input of the time displayed by the display unit of the timepiece may be received by operating the switch.

In addition, a time correction system according to another aspect of the present invention includes an imaging unit that images the display unit of the timepiece and an identification unit that identifies the time displayed by the display unit of the timepiece from an image captured by the imaging unit. The input unit receives an input of the time which is identified by the identification unit and which is displayed by the display unit of the timepiece.

According to the present embodiment of the present invention, there is provided an electronic device in a time correction system including a timepiece having a display unit for causing an indicating hand to display the time and the electronic device. The electronic device includes at least an acquisition unit, an input unit, a time correction amount calculation unit, and a transmitting unit. The acquisition unit acquires the current time. The input unit receives an input of the time displayed by the display unit of the timepiece . The time correction amount calculation unit calculates a time correction amount for correcting the time of the timepiece from a difference between the time, the input of which is received by the input unit and the current time acquired by the acquisition unit. The transmitting unit transmits the time correction amount calculated by the time correction amount calculation unit to the timepiece by using light.

According to the present embodiment of the present invention, there is provided a timepiece in a time correction system including the timepiece having a display unit for causing an indicating hand to display the time and an electronic device. The timepiece includes at least a receiving unit, a power storage unit, a drive unit, and a control unit. The receiving unit receives a time correction amount for correcting the time which is transmitted from the electronic device by using light. The power storage unit stores electricity by using power converted from the light. The drive unit drives the indicating hand. The control unit corrects the time displayed by the indicating hand, based on the time correction amount received by the receiving unit. The control unit controls a power storage period in the power storage unit and a receiving period in the receiving unit so as to receive the time correction amount in the receiving period.

According to the present embodiment of the present invention, there is provided a program that causes a computer to execute a process as an electronic device in a time correction system which includes a timepiece having a display unit for causing an indicating hand to display the time and the electronic device. The process includes a step of acquiring the current time, a step of receiving an input of the time displayed by the display unit of the timepiece, a step of calculating a time correction amount for correcting the time of the timepiece from a difference between the time, the input of which is received in the step of receiving the input and the current time acquired in the step of acquiring, and a step of transmitting the time correction amount calculated in the step of calculating the time correction amount to the timepiece by using light.

REFERENCE SIGNS LIST

1, 2 TIME CORRECTION SYSTEM
10, 30 ELECTRONIC DEVICE
20 ELECTRONIC TIMEPIECE
101 TIME DATA ACQUISITION UNIT
102 CONTROL UNIT
103 LIGHT SOURCE
104 IMAGING UNIT
105 DISPLAY UNIT
106 INPUT UNIT
201 SOLAR CELL
202 CONTROL CIRCUIT
203 SWITCH
204 SECONDARY BATTERY
205 DIODE
206 REFERENCE SIGNAL GENERATION CIRCUIT
207 STEPPING MOTOR
208 DISPLAY UNIT
209 STORAGE UNIT
210 INPUT UNIT
2081 DIAL
2082 INDICATING HAND
2083 DATE DISPLAY SECTION

The invention claimed is:

1. A time correction system comprising:
a timepiece that has a display unit which causes an indicating hand to display the time; and
an electronic device,
wherein the electronic device includes
an acquisition unit that acquires the current time,
an input unit that receives an input of the time displayed by the display unit of the timepiece,
a time correction amount calculation unit that calculates a time correction amount for correcting the time of the timepiece from a difference between the inputted time received by the input unit and the current time acquired by the acquisition unit, and
a transmitting unit that transmits the time correction amount calculated by the time correction amount calculation unit to the timepiece by using light,
wherein the timepiece includes
a receiving unit that receives the time correction amount from the electronic device,
a power storage unit that stores electricity by using power which is converted from the light,
a drive unit that drives the indicating hand, and
a control unit that corrects the time displayed by the indicating hand, based on the time correction amount received by the receiving unit, and
wherein the control unit controls a power storage period in the power storage unit and a receiving period in the receiving unit so as to receive the time correction amount in the receiving period.

2. The time correction system according to claim 1,
wherein the transmitting unit of the electronic device transmits the current time together with the time correction amount,
wherein the receiving unit of the timepiece receives the current time together with the time correction amount,
wherein the timepiece includes a clocking unit which clocks the current time, and
wherein the control unit of the timepiece corrects the current time clocked by the clocking unit, based on the current time received by the receiving unit.

3. The time correction system according to claim 1,
wherein the electronic device includes a stopping unit which stops driving the indicating hand of the timepiece, and
wherein the control unit of the timepiece restarts the driving of the indicating hand, if the receiving unit receives the time correction amount.

4. The time correction system according to claim 3,
wherein the electronic device includes an additional correction amount calculation unit which calculates an additional correction amount corresponding to a period of time required for correction in the timepiece, based on the time correction amount calculated by the time correction amount calculation unit, and which adds the calculated additional correction amount to the time correction amount.

5. The time correction system according to claim 3,
wherein the stopping unit of the electronic device transmits a stop signal for stopping the driving of the indicating hand to the timepiece, and
wherein the control unit of the timepiece stops the driving of the indicating hand, if the control unit receives the stop signal.

6. The time correction system according to claim 3,
wherein the electronic device includes a display unit,
wherein the stopping unit of the electronic device displays an instruction to stop the driving of the indicating hand on the display unit,
wherein the timepiece includes an input unit which receives an operation input, and wherein the control unit of the timepiece stops the driving of the indicating hand, if the input unit receives the operation input for stopping the driving the indicating hand.

7. The time correction system according to claim 1, wherein the transmitting unit of the electronic device is a light source which transmits an optical signal, and wherein the receiving unit of the timepiece is a solar cell which receives the optical signal.

8. The time correction system according to claim 1, wherein the input unit includes a switch, and receives an input of the time displayed by the display unit of the timepiece through an operation of the switch.

9. The time correction system according to claim 1, further comprising:

an imaging unit that images the display unit of the timepiece; and an identification unit that identifies the time displayed by the display unit of the timepiece from an image captured by the imaging unit, wherein the input unit receives an input of the time which is identified by the identification unit and which is displayed by the display unit of the timepiece.

10. A timepiece in a time correction system which includes a timepiece having a display unit for causing an indicating hand to display the time and an electronic device, the timepiece comprising:

a receiving unit that receives a time correction amount which is transmitted from the electronic device by using light in order to correct the time;

a power storage unit that stores electricity by using power which is converted from the light;

a drive unit that drives the indicating hand; and a control unit that corrects the time displayed by the indicating hand, based on the time correction amount received by the receiving unit, wherein the control unit controls a power storage period in the power storage unit and a receiving period in the receiving unit so as to receive the time correction amount in the receiving period.

* * * * *